US011300915B2

(12) United States Patent
Kaneko et al.

(10) Patent No.: US 11,300,915 B2
(45) Date of Patent: Apr. 12, 2022

(54) TRANSPORT GUIDE DEVICE, SHEET-SHAPED OBJECT PROCESSING APPARATUS, AND POWDER USING APPARATUS

(71) Applicant: FUJIFILM BUSINESS INNOVATION CORP., Tokyo (JP)

(72) Inventors: Atsushi Kaneko, Kanagawa (JP); Keita Hashimoto, Kanagawa (JP); Hirokazu Ichihara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/142,849

(22) Filed: Jan. 6, 2021

(65) Prior Publication Data

US 2022/0035297 A1 Feb. 3, 2022

(30) Foreign Application Priority Data

Jul. 31, 2020 (JP) ..... JP2020-130721

(51) Int. Cl.
*G03G 15/00* (2006.01)
*G03G 15/16* (2006.01)

(52) U.S. Cl.
CPC ..... *G03G 15/6558* (2013.01); *G03G 15/1615* (2013.01)

(58) Field of Classification Search
CPC ..... G03G 15/6558; G03G 15/1615; G03G 2215/00607; G03G 2215/00675
See application file for complete search history.

(56) References Cited

U.S. PATENT DOCUMENTS 5,594,539 A 1/1997 Murano et al.
2007/0231032 A1* 10/2007 Matsuno ..... G03G 15/6558 399/388
2007/0280750 A1* 12/2007 Kurosu ..... G03G 15/6558 399/316
2018/0046125 A1* 2/2018 Watanabe ..... G03G 15/6558

FOREIGN PATENT DOCUMENTS

JP 2002-258634 A 9/2002
JP 3386235 B2 3/2003
JP 2006-343657 A 12/2006

* cited by examiner

*Primary Examiner* — Sandra Brase
(74) *Attorney, Agent, or Firm* — Oliff PLC

(57) ABSTRACT

A transport guide device includes: a first guide unit including a guide portion configured to guide a sheet-shaped object along a transport path; and a second guide unit including a fixed first end portion and a non-fixed second end portion opposite to the fixed first end portion, the second end portion (i) approaching the guide portion toward a downstream side in a transport direction of the sheet-shaped object and then contacts with the guide portion or (ii) approaching the guide portion toward the downstream side in the transport direction of the sheet-shaped object, the second guide unit being configured to guide the sheet-shaped object such that the sheet-shaped object comes into contact with the guide portion, in which the second guide unit includes a tip end protrusion at a tip end of the second end portion, the tip end protrusion protruding in a direction away from the guide portion.

19 Claims, 13 Drawing Sheets

COMPARATIVE EXAMPLE

COMPARATIVE EXAMPLE

TRANSPORT GUIDE DEVICE, SHEET-SHAPED OBJECT PROCESSING APPARATUS, AND POWDER USING APPARATUS

CROSS-REFERENCE TO RELATED APPLICATIONS

This application is based on and claims priority under 35 USC 119 from Japanese Patent Application No. 2020-130721 filed Jul. 31, 2020.

BACKGROUND

(i) Technical Field

The present disclosure relates to a transport guide device, a sheet-shaped object processing apparatus, and a powder using apparatus.

(ii) Related Art

In the related art, for example, an apparatus described in JP-A-2006-34657 (see claims 1 and 2, paragraph 0025, and FIGS. 1 to 3) addresses an issue caused by powder dust containing powder.

JP-A-2006-34657 describes an electrophotographic recording apparatus which includes a photoconductor, a transfer device, a fixing device, and a developing device having a carrier recovery member and performs developing using a two-component developer. In the electrophotographic recording apparatus, a falling carrier collection member is provided below the developing device or above a duplex printing transport system downstream of the carrier recovery member.

Further, as disclosed in JP-A-2006-34657, since the falling carrier collection member collects scattered carriers that may not be collected by the carrier recovery member and fall, the scattered carriers do not fall onto the paper before transfer, or the wide paper does not take the scattered carriers that have fallen and accumulated on the duplex printing transport system.

SUMMARY

Aspects of non-limiting embodiments of the present disclosure relate to a transport guide device, a sheet-shaped object processing apparatus, and a powder using apparatus that prevent powder dust adhering to and accumulated on a portion of a second guide unit, which guides a sheet-shaped object such that the sheet-shaped object comes into contact with a guide portion along a transport path and which is opposite to the guide portion from being peeled off and contaminating the sheet-shaped object, as compared with a case where no tip end protrusion protruding in a direction away from the guide portion is provided at a tip end of a non-fixed end portion of the second guide unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transport guide device including: a first guide unit including a guide portion configured to guide a sheet-shaped object along a transport path; and a second guide unit including a fixed first end portion and a non-fixed second end portion opposite to the fixed first end portion, the second end portion (i) approaching the guide portion toward a downstream side in a transport direction of the sheet-shaped object and then contacts with the guide portion or (ii) approaching the guide portion toward the downstream side in the transport direction of the sheet-shaped object, the second guide unit being configured to guide the sheet-shaped object such that the sheet-shaped object comes into contact with the guide portion, in which the second guide unit includes a tip end protrusion at a tip end of the second end portion, the tip end protrusion protruding in a direction away from the guide portion.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described with reference to the accompanying drawings.

First Exemplary Embodiment

Figure 1A:
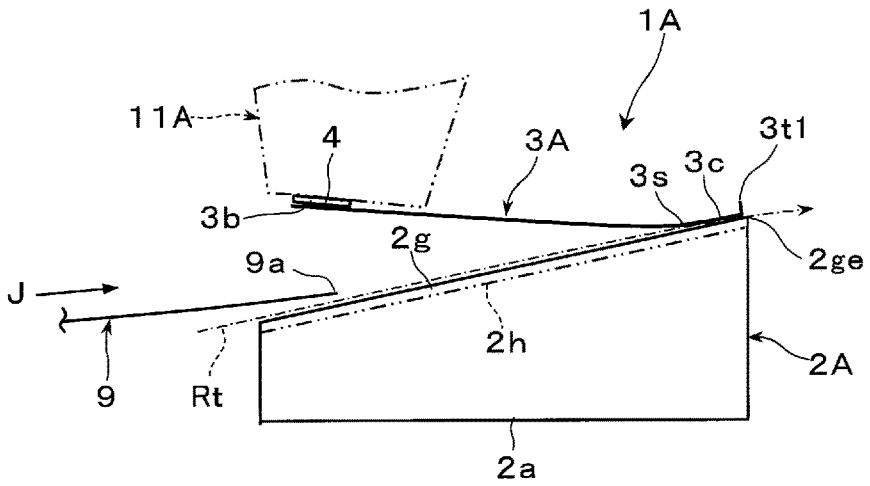
FIG. 1A is a side view conceptually illustrating a transport guide device according to a first exemplary embodiment.
Figure 1B:
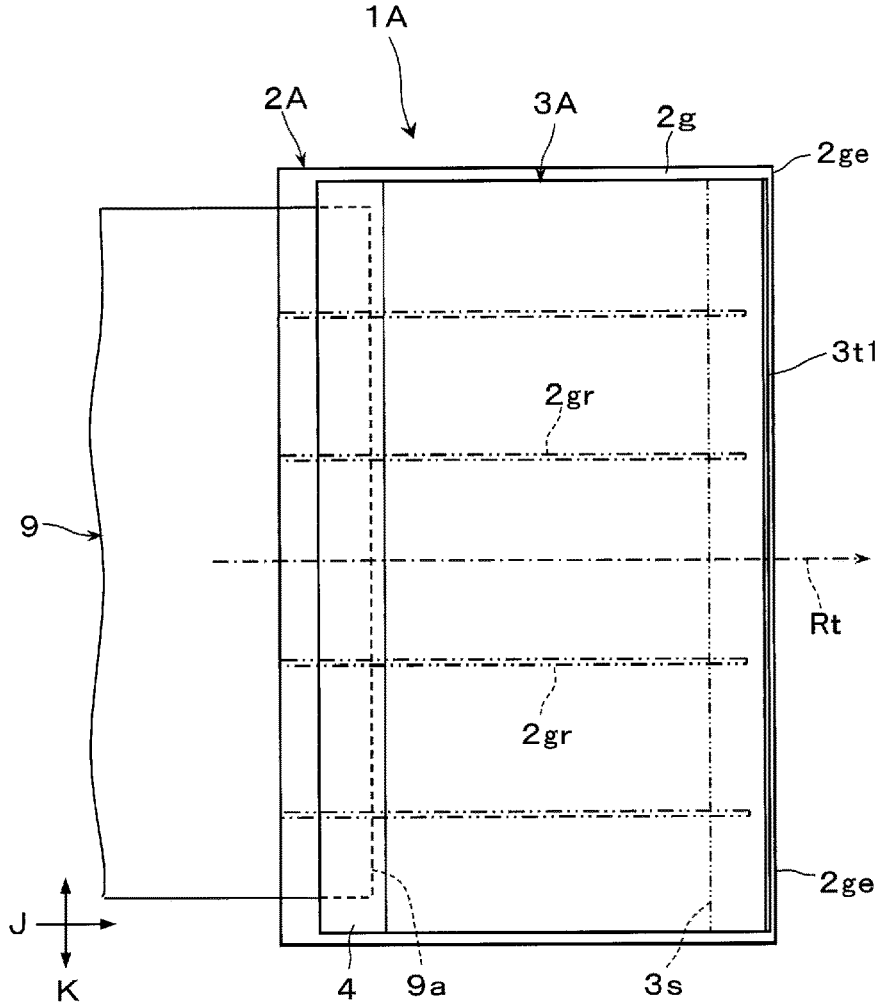
FIG. 1B is a plan view conceptually illustrating the transport guide device.

FIGS. 1A and 1B illustrate a transport guide device 1A according to a first exemplary embodiment of the present disclosure.

The transport guide device 1A includes (i) a first guide unit 2A including a guide portion 2*g* that guides a sheet-shaped object 9 along a transport path Rt, and (ii) a second guide unit 3A that guides the sheet-shaped object 9 such that the sheet-shaped object 9 comes into contact with the guide portion 2*g* of the first guide unit 2A.

The first guide unit 2A includes an immovable member fixed at a required position in the transport path Rt along which the sheet-shaped object 9 is transported. The first guide unit 2A is a so-called immovable first guide unit. The immovable member is a member that does not move itself at a position at which the immovable member is disposed.

The first guide unit 2A includes a main body 2*a* having a required shape and the guide portion 2*g* provided on the top of the main body 2*a*.

The main body 2*a* is fixed to a required member (for example, support member) inside an attachment target device (not illustrated) in which the transport guide device 1A is disposed. The guide portion 2*g* is fixed at a required position on the upper portion of the main body 2*a*. The main body 2*a* and the guide portion 2*g* are a part of a fixed member. For example, the main body 2*a* and the guide portion 2*g* are a part of the immovable member. Further, for example, the main body 2*a* and the guide portion 2*g* are made of material such as synthetic resin. The main body 2*a* may be combined with a part of another fixed member so as to constitute an integrated body.

The sheet-shaped object 9 may be any one which requires to be guided and transported by the transport guide device 1A and which is applicable. In the transport guide device 1A, for example, a paper, sheet, or a thick paper which is cut to a desired size is applied as the sheet-shaped object 9. Further, the sheet-shaped object 9 is transported to reach the transport guide device 1A along a part of the transport path Rt, by a transport device (not illustrated) disposed in a device to which the transport guide device 1A is applied.

The guide portion 2*g* is a portion that is formed to exert the function of transporting and guiding the sheet-shaped object 9 along the transport path Rt.

The guide portion 2*g* is configured as a surface including a region that guides the transport of the sheet-shaped object 9. Elongated projections 2*gr* are provided on a part of the surface. The elongated projections 2*gr* are, for example, ribs which are parallel to each other along a transport direction J of the sheet-shaped object 9 and extend in a long and thin manner. Reference sign "2*h*" in FIG. 1A indicates (a height of) a surface on which the elongated projections 2*gr* are formed when the portion indicated by reference sign "2*g*" is regarded as the elongated projections 2*gr*.

The surface constituting the guide portion 2*g* is a flat surface. Further, the elongated projections constituting the guide portion 2*g* are also formed into a shape in which the upper end (surface) thereof extends linearly.

Figure 3A:
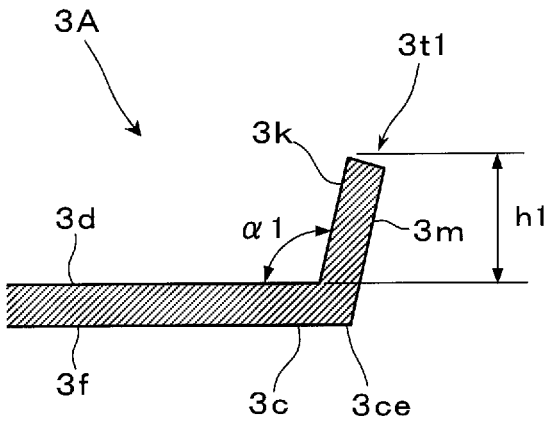
FIG. 3A is an enlarged schematic cross-sectional view illustrating a tip end protrusion of the second guide unit of FIGS. 2A and 2B.
Figure 3B:
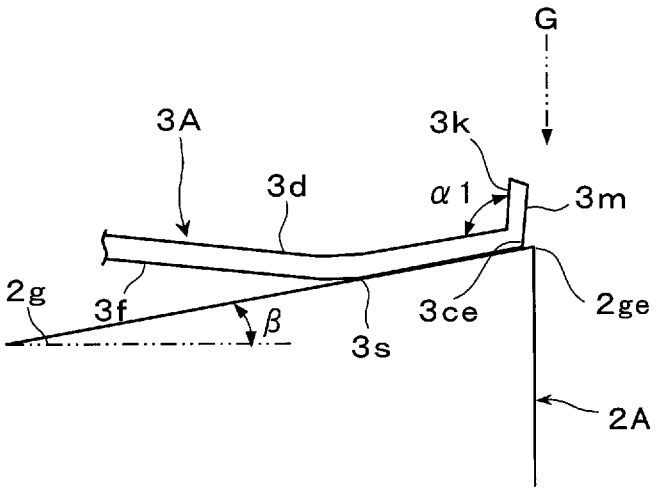
FIG. 3B is a major part schematic view illustrating a state where the second guide unit of FIGS. 2A and 2B is in contact with a guide portion of a first guide unit.

Further, the guide portion 2*g* is a portion that is inclined at a required inclination angle θ to gradually rise toward the downstream side in the transport direction J of the sheet-shaped object 9 (see, for example, FIG. 3B).

Furthermore, with respect to the length of the guide portion 2*g* along the transport direction J of the sheet-shaped object 9 and the length (width) of the guide portion 2*g* in a direction that is intersects the transport direction J and that is the width direction K of the sheet-shaped object 9 in transport, the guide portion 2*g* is set according to, for example, the dimension of the sheet-shaped object 9 to be transported or the dimension that is required to transport and guide the sheet-shaped object 9 along the transport path Rt.

As illustrated in FIGS. 1A, 1B, 2A, and 2B, the second guide unit 3A includes a plate-shaped main body 3*a* having a substantially rectangular plane.

Further, the second guide unit 3A includes a fixed first end portion 3*b* of the main body 3*a* and a non-fixed second end portion 3*c* opposite to the fixed first end portion 3*b*. The first end portion 3*b* is fixed to a required attachment target 11 by a fixing unit 4. The second end portion 3*c* approaches the guide portion 2*g* of the first guide unit 2A toward a downstream side in the transport direction J of the sheet-shaped object 9 and then contacts with the guide portion. The non-fixed second end portion 3*c* is a free end.

The main body 3*a* may be any one that has a planar shape or area required to face the region of the guide portion 2*g*.

Figure 2A:
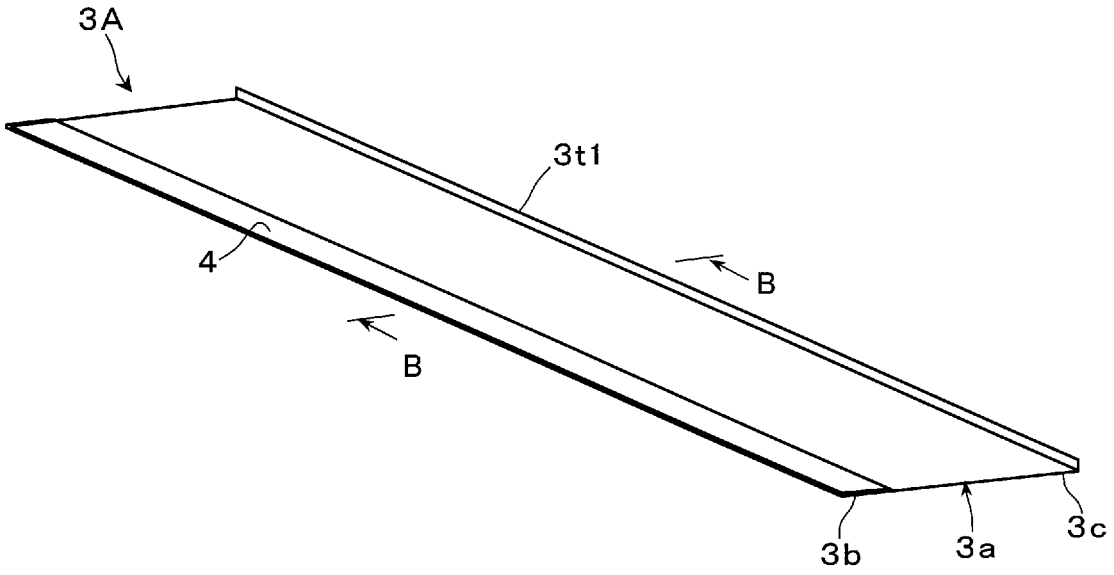
FIG. 2A is a perspective view illustrating a second guide unit in the transport guide device of FIGS. 1A and 1B.
Figure 2B:
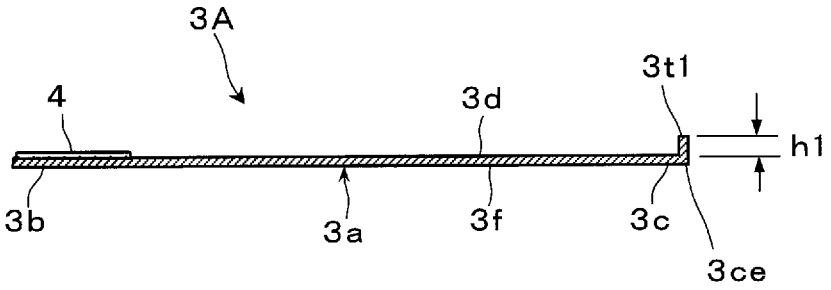
FIG. 2B is a schematic cross-sectional view taken along line B-B of the second guide unit.

As illustrated in FIG. 1B or 2A, the main body 3*a* according to the first exemplary embodiment has a rectangular planar shape that is longer in the width direction K, and also has an area by which the main body 3*a* faces substantially the entire region of the guide portion 2*g* towards the downstream side thereof except for an upstream end region of the guide portion 2*g* in the transport direction J.

Further, the main body 3*a* according to the first exemplary embodiment includes a sheet-shaped elastic member having such elasticity that at least a region on the second end portion 3*c* side elastically deforms to bend when the second end portion 3*c* comes into contact with the guide portion 2*g* and when the sheet-shaped object 9 to be transported passes and come into contact with the second end portion 3*c*. As a member that constitutes the main body 3*a* including this sheet-shaped elastic member, for example, a sheet made of a resin material such as polyethylene terephthalate is used. The second guide unit 3A having the main body 3*a* including this sheet-shaped elastic member may also be referred to as, for example, a guide sheet.

Examples of the attachment target 11 to which the first end portion 3*b* of the second guide unit 3A is fixedly attached include a structure that is disposed near the transport guide device 1A and has a portion opposing the second guide unit 3A, and a support member that is provided exclusively to fix first end portion 3*b* of the second guide unit 3A. An attachment target 11A according to the first exemplary embodiment is one that is fixed. The attachment target 11 may be an attachment target 11B including a component (including a device) which is replaceable at a required timing as described below.

Further, the fixing unit 4 that fixes the first end portion 3*b* of the second guide unit 3A to the attachment target 11A is not particularly limited, and for example, a double-sided adhesive tape or an adhesive is applied.

Then, as illustrated in FIGS. 1A, 1B, 2A, and 2B, the second guide unit 3A of the transport guide device 1A includes a tip end protrusion 3*t* at a tip end of the second end portion 3*c* thereof. The tip end protrusion 3*t* protrudes in a direction away from the guide portion 2*g* of the first guide unit 2A.

Here, the tip end of the second end portion 3*c* is the most downstream end of the second end portion 3*c* in the transport direction J. Further, reference sign "3*t*1" is assigned to the tip end protrusion in FIGS. 1A and 1B. It is noted that this is to identify that the tip end protrusion is configured according to the first exemplary embodiment. In the following, reference sign "3*t*" is assigned when simply indicating a conceptual tip end protrusion.

As illustrated in FIGS. 3A and 3B, the tip end protrusion 3*t* is a portion including a surface 3*k* which rises at least in a direction away from the guide portion 2*g*. The rising surface 3*k* is a surface that may be visually recognized from the first end portion 3*b* of the second guide unit 3A. In other words, the rising surface 3*k* is also a surface that is located on an upstream side of the tip end protrusion 3*t* in the transport direction J of the sheet-shaped object 9. This rising surface 3*k* is a substantially flat surface. Alternatively, the rising surface 3*k* may be a curved surface or a bent surface.

The tip end protrusion 3*t*1 according to the first exemplary embodiment is a portion formed by bending the second end portion 3*c* of the main body 3*a* that extends from the first end portion 3*b* to the second end portion 3*c* of the second guide unit 3A. Such a tip end protrusion 3*t*1 is formed by bending the second end portion 3*c* of the main body 3*a*, or by a manufacturing method such as vacuum forming or injection molding.

Further, as illustrated in FIG. 3A, the rising angle $\alpha$1 of the rising surface 3*k* of the tip end protrusion 3*t*1 is set to a suitable value from various viewpoints. The rising angle $\alpha$1 at this time is an angle between the rising surface 3*k* and a surface (upper surface) 3*d* of the second guide unit 3A opposite to a guide surface (lower surface) 3*f* that guides the sheet-shaped object 9 when the second guide unit 3A is placed on a flat place.

The rising angle $\alpha$1 is set to a value which is effective at least to prevent accumulated powder dust 101 (FIGS. 5A and 5B) to be described below from being peeled off and falling.

As illustrated in FIG. 3B, the rising angle $\alpha$1 of the rising surface 3*k* may be set from the viewpoint of causing the rising surface 3*k* to be in an appropriate state when the second guide unit 3A is mounted such that the non-fixed second end portion 3*c* contacts with the guide portion 2*g*.

In addition, the tip end protrusion 3*t*1 may be configured such that the intersection angle of the rising surface 3*k* with respect to the gravity direction G at the attachment stage of the second guide unit 3A is within, for example, ±45°. In FIGS. 3A and 3B, reference sign "3*m*" indicates a surface (a surface located on the downstream side in the transport direction J of the sheet-shaped object 9) of the tip end protrusion 3*t*1 opposite to the rising surface 3*k*.

Furthermore, the protruding height h1 of the tip end protrusion 3*t*1 is set to a suitable value from various viewpoints. The protruding height h1 is the height dimension of a portion of the main body 3*a* protruding from the upper surface 3*d* opposite to the guide surface 3*f*. Further, the protruding height h1 may be a value of at least 1 mm or more. The protruding height h1 is set appropriately from the viewpoint of, for example, (i) an amount required to prevent the accumulated powder dust 101 (see, for example, FIGS. 5A and 5B) to be described below from being peeled off and falling and (ii) prevention of a deterioration in the guidance function due to an increased weight.

As illustrated FIGS. 1A and 3B, in the second guide unit 3A including the tip end protrusion 3*t*1, the first end portion 3*b* thereof is fixed by the fixing unit 4 at such a position that a gap required to introduce the sheet-shaped object 9 is formed between the second guide unit 3A and the guide portion 2*g* of the first guide unit 2A having the inclination angle (3, whereas the second end portion 3*c* thereof gradually approaches the guide portion 2*g* toward the downstream side in the transport direction J of the sheet-shaped object 9 and then contacts with the guide portion 2*g* at an acute intersection angle.

At this time, the second guide unit 3A is disposed such that as illustrated in FIG. 3B, (i) the second end portion 3*c* begins to contact at an intermediate portion 3*s* thereof with the guide portion 2*g* and then continues to contact with the guide portion 2*g* up to a downstream end portion 2*ge* of the guide portion 2*g* in the transport direction J, and (ii) a portion of a tip end 3*ce* including the tip end protrusion 3*t*1 is located at the same position as the downstream end portion 2*ge* of the guide portion 2*g* or is deviated from the downstream end portion 2*ge* to the upstream side in the transport direction J.

Further, at this time, the main body 3*a* of the second guide unit 3A includes the sheet-shaped elastic member. Thus, as illustrated in FIG. 1A, the second guide unit 3A is elastically deformed so as to be bulge downward and is slightly bent. The second guide unit 3A may not be necessarily to be disposed in a downwardly bent state except for that the second guide unit 3A is bent by its own weight.

The transport guide device 1A described above guides and transports the sheet-shaped object 9 to be transported, as described below.

First, in the transport guide device 1A, as illustrated in FIG. 1A, when the sheet-shaped object 9 is transported from the upstream side of the transport path Rt in the transport direction J, a leading end 9*a* of the sheet-shaped object 9 is introduced into the space between the guide portion 2*g* of the first guide unit 2A and the first end portion 3*b* of the second guide unit 3A.

Figure 4A:
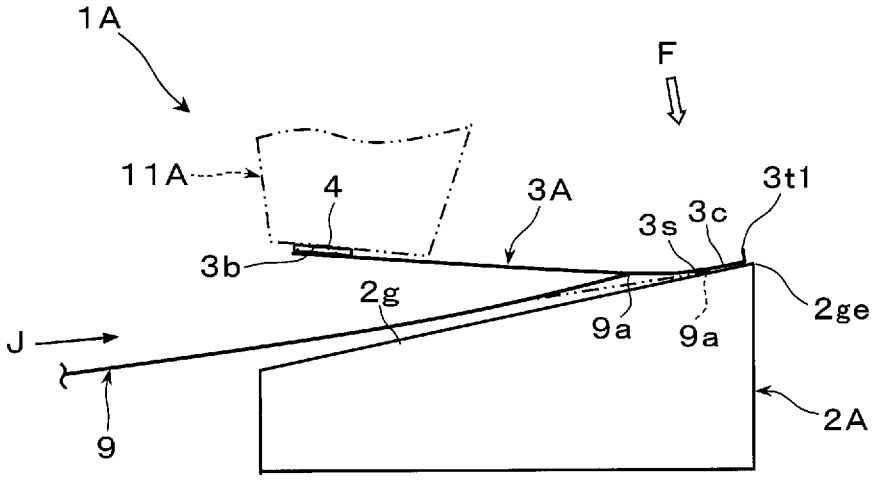
FIG. 4A is a conceptual view illustrating a transport guide state by the transport guide device of FIGS. 1A and 1B.
Figure 4B:
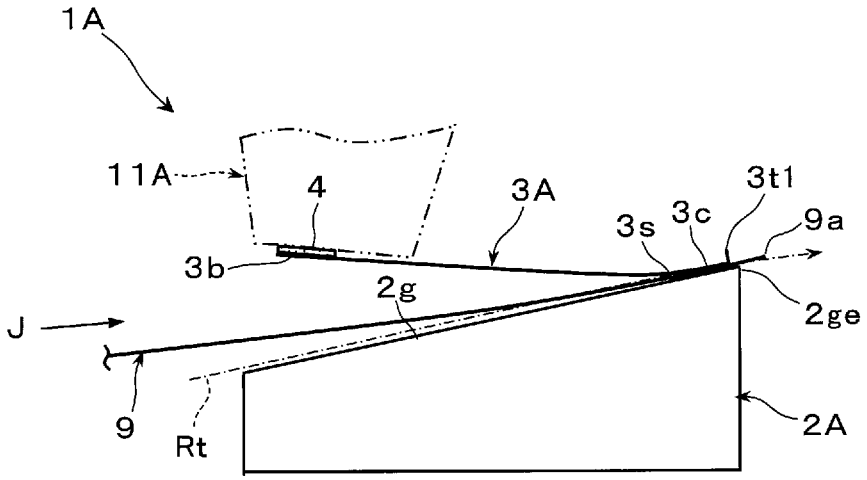
FIG. 4B is a conceptual view illustrating another transport guide state by the transport guide device of FIGS. 1A and 1B.

Subsequently, in the transport guide device 1A, as illustrated in FIG. 4A, a part of the introduced sheet-shaped object 9 such as the leading end 9*a* comes into contact with a part of the guide surface 3*f* which is the lower surface of the second guide unit 3A after it comes into contact with a part of the guide portion 2*g* or from the beginning. After that, the second guide unit 3A guides a part of the sheet-shaped object 9 such as the leading end 9*a* so as to proceed along the guide surface 3*f* and then finally come into contact with the guide portion 2*g* as illustrated by the two dot dash line in FIG. 4A.

After that, in the transport guide device 1A, the second guide unit 3A continues to press the sheet-shaped object 9 against the guide portion 2*g* with a required force F. Thus, the sheet-shaped object 9 proceeds in contact with the guide portion 2*g* while receiving the pressing force F from the second guide unit 3A. At this time, the pressing force F from the second guide unit 3A substantially corresponds to, for example, a force required to elastically deform the elastic main body 3*a* of the second guide unit 3A in a direction away from the guide portion 2*g*.

In this way, in the transport guide device 1A, the sheet-shaped object 9 is guided to proceed so as to substantially come into contact with the guide portion 2*g* at a position where it passes through at least the second end portion 3*c* of the second guide unit 3A. Thus, the sheet-shaped object 9 is transported substantially along the transport path Rt as it passes in contact with the guide portion 2*g*.

Figure 5A:
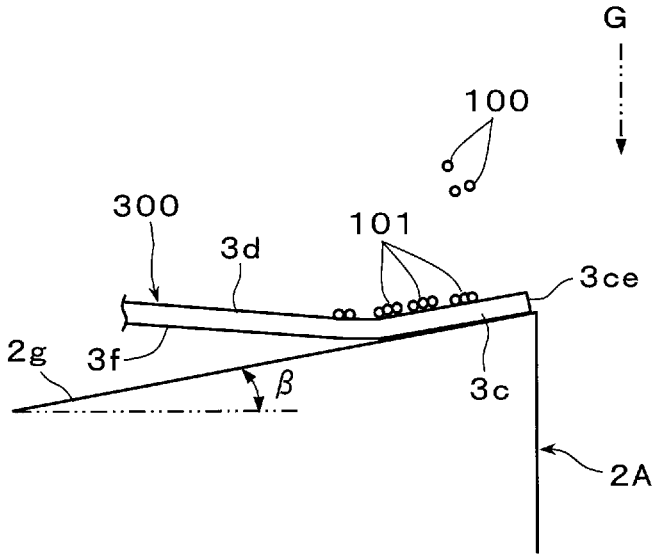
FIG. 5A is a major part schematic view illustrating a state where powder dust is accumulated on a second guide unit according to a comparative example.

In the meantime, in such a transport guide device 1A, as illustrated in FIG. 5A, powder dust 100 such as powder around the transport guide device 1A floats, and a part 101 of the powder dust 100 falls due to gravity, thus adhering to and being gradually accumulated on the upper surface 3*d* of the second guide unit 3A opposite to the guide surface 3*f*.

Moreover, a part of the accumulated powder dust 101 may be peeled off due to an impact received when a part of the sheet-shaped object 9 to be transported such as the leading end 9*a* comes into contact with the guide surface 3*f* of the second guide unit 3A.

Here, in the transport guide device 1A, as illustrated in FIG. 5A, when a second guide unit 300 of a comparative example having a configuration in which the second end portion 3*c* includes no tip end protrusion 3*t*1 of the second guide unit 3A is applied instead of the second guide unit 3A, the sheet-shaped object 9 may be contaminated as follows.

Figure 5B:
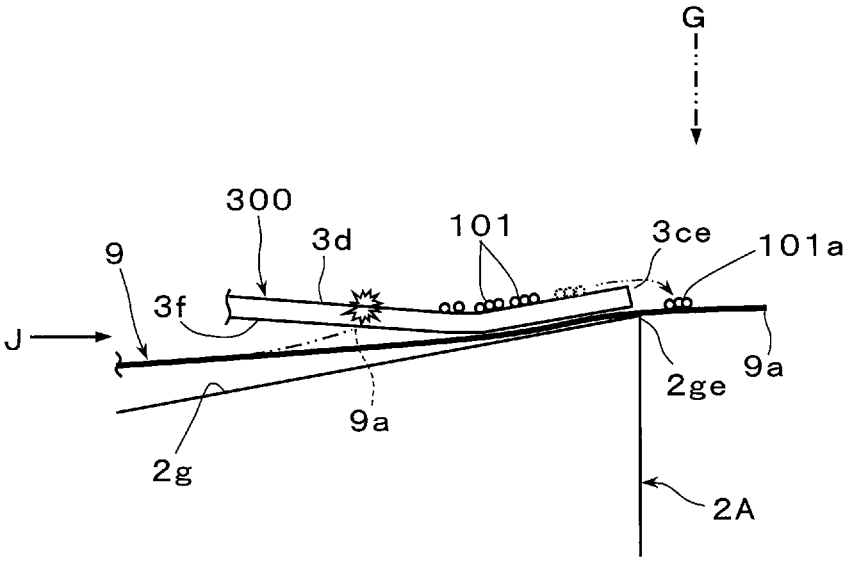
FIG. 5B is a major part schematic view illustrating an example in which powder dust accumulated on the second guide unit according to the comparative example is peeled off and contaminates a sheet-shaped object.

That is, in the transport guide device 1A to which this second guide unit 300 is applied, as illustrated in FIG. 5B, when a part of the powder dust 101 accumulated on the upper surface 3*d* of the second guide unit 3A is peeled off due to an impact received when a part of the sheet-shaped object 9 being transported such as the leading end 9*a* comes into contact with the guide surface 3*f* of the second guide unit 300, the peeled-off powder dust 101*a* falls down from the upper surface 3*d* of the second guide unit 300 onto the sheet-shaped object 9 passing below the second guide unit 3A at that time, thus contaminating the sheet-shaped object 9. Further, when the second guide unit 3A includes an elastic member, the powder dust accumulated on the elastic second guide unit 3A is easier to be peeled off and also easier to fall from the second guide unit 3A.

At this time, a part of the peeled-off powder dust 101*a* may move to and fall from lateral end portions of the second guide unit 300 in the width direction K. However, since the dimension of the second guide unit 300 in the width direction K is greater than the width of the sheet-shaped object 9, there is no risk of a part of the peeled-off powder dust 101*a* falling onto the sheet-shaped object 9.

Meanwhile, in the transport guide device 1A according to the first exemplary embodiment, since the second guide unit 3A including the tip end protrusion 3*t*1 is applied, even when a part of the powder dust 101 accumulated on the upper surface 3*d* of the second guide unit 3A is peeled off as described above during the transport of the sheet-shaped object 9, the peeled-off powder dust 101*a* is blocked by (the rising surface 3*k* of) the tip end protrusion 3*t*1 when moving to the tip end 3*ce* side of the second end portion 3*c* of the second guide unit 3A.

Therefore, according to the transport guide device 1A, a part of the powder dust 101 accumulated on the upper surface 3*d* of the second guide unit 3A is prevented from being peeled off and contaminating the sheet-shaped object 9, as compared with a case where the second guide unit 300 including no tip end protrusion 3*t*1 is applied.

Further, in the transport guide device 1A, since the tip end protrusion 3*t*1 of the second guide unit 3A is the portion formed by bending the second end portion 3*c* of the main body 3*a*, the peeling-off of the accumulated powder dust 101 is easily prevented by the tip end protrusion 3*t*1 having a simple and lightweight structure without impairing the guidance function of the second guide unit 3A, as compared with a case where the tip end protrusion 3*t* is not the bent portion described above.

Further, in the transport guide device 1A, the main body 3*a* of the second guide unit 3A includes the sheet-shaped elastic member. Thus, the generation of an impact caused when the sheet-shaped object 9 comes into contact with the guide surface 3*f* of the second guide unit 3A is prevented, and the sheet-shaped object 9 is easier to smoothly pass without receiving unnecessary transport resistance due to the contact with the second guide unit 3A, as compared with a case where the main body 3*a* of the second guide unit 3A includes no sheet-shaped elastic member.

In addition, in the transport guide device 1A, the first guide unit 2A includes a fixed immovable member. Thus, the powder dust 101 accumulated on the second guide unit 3A is prevented from being peeled off and contaminating the sheet-shaped object 9, and the sheet-shaped object 9 is guided by the second guide unit 3A so as to come into contact with the guide portion 2*g* of the immovable first guide unit 2A.

Modifications of First Exemplary Embodiment

Figure 6A:
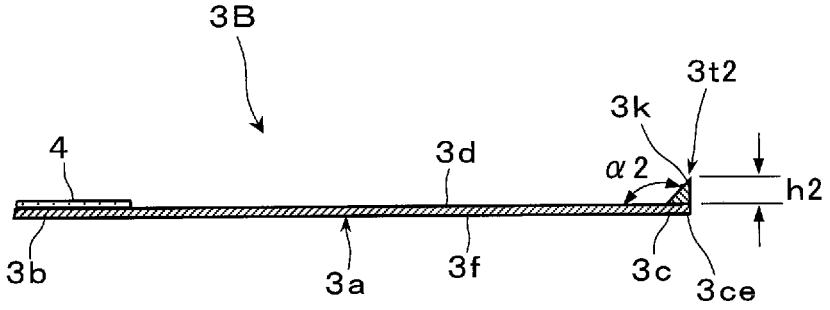
FIG. 6A is a schematic cross-sectional view illustrating a second guide unit according to a modification of the first exemplary embodiment.
Figure 6B:
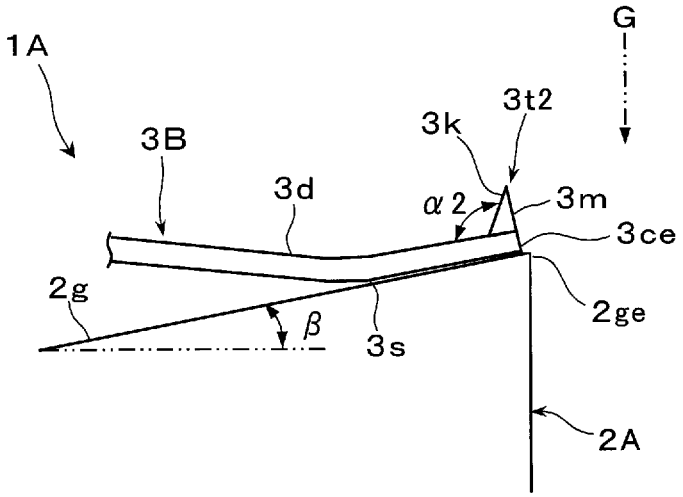
FIG. 6B is a major part schematic view illustrating a state where the second guide unit according to the modification of the first exemplary embodiment is in contact with the guide portion of the first guide unit.

A second guide unit 3B exemplified in FIGS. 6A and 6B may also be applied to the transport guide device 1A according to the first exemplary embodiment.

The second guide unit 3B adopts, as the tip end protrusion 3*t*, a tip end protrusion 3*t*2 that is another member attached to the second end portion 3*c* of the main body 3*a* to protrude in a direction away from the guide portion 2*g*. The "other member" (another member) refers to a different (additionally provided) member independent of the main body 3*a*.

The tip end protrusion 3*t*2 may have any shape that is substantially linearly continuous in the width direction K of the second end portion 3*c* of the main body 3*a* and that includes the surface 3*k* that rises in a direction away from the guide portion 2*g*. In FIGS. 6A and 6B, the tip end protrusion 3*t*2 is illustrated as having a right triangular cross-sectional shape. It is noted that the cross-sectional shape of the tip end protrusion 3*t*2 is not limited to this example. As such a tip end protrusion 3*t*2, for example, a molded article made of a different material from the material of the main body 3*a* or a foam body having physical properties different from those of the main body 3*a* may be applied. Alternatively, the tip end protrusion 3*t*2 may include a member made of the same material as the material of the main body 3*a*.

When the second guide unit 3B including the tip end protrusion 3*t*2 is applied, the peeling-off of the accumulated powder dust 101 may be appropriately prevented by the tip end protrusion 3*t*2 having desirably selected physical properties or shapes, as compared with a case where the tip end protrusion of the second guide unit includes no other member provided on the second end portion 3*c* of the main body 3*a*.

Figure 7A:
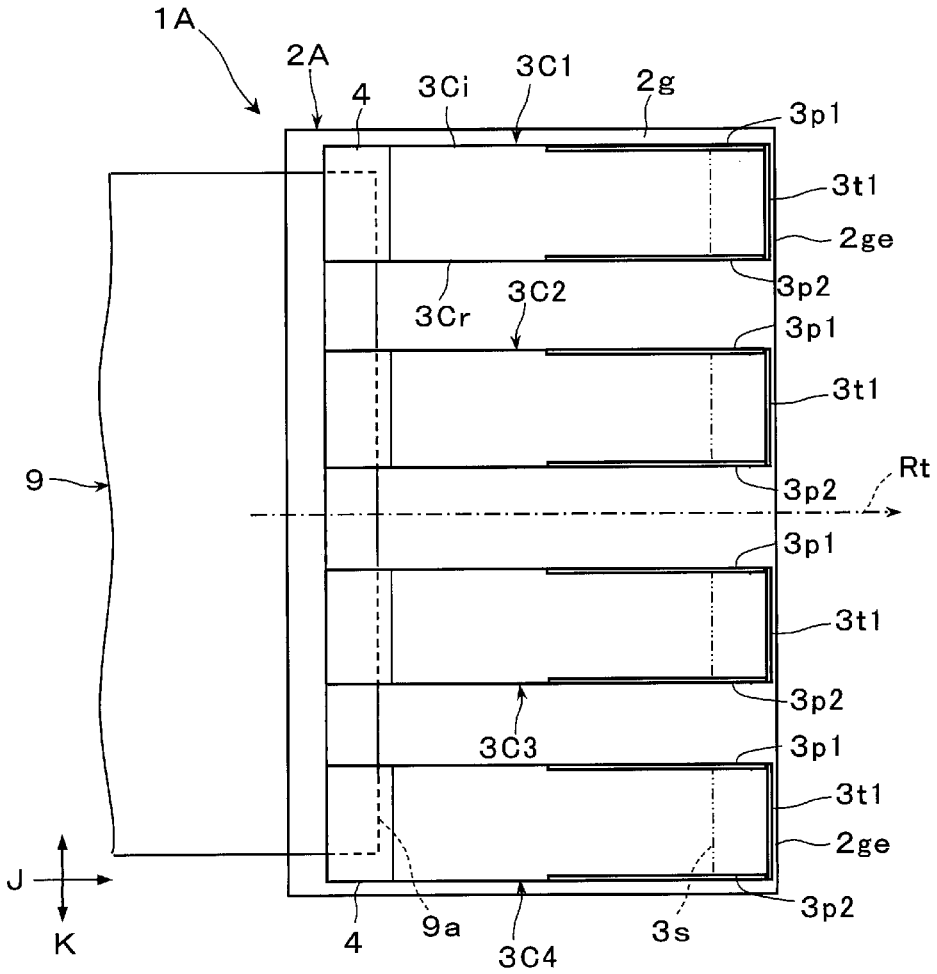
FIG. 7A is a schematic plan view illustrating a second guide unit according to another modification of the first exemplary embodiment.
Figure 7B:
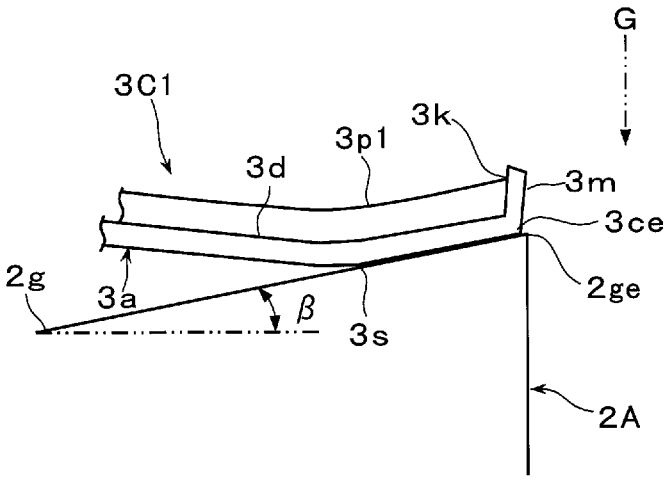
FIG. 7B is a major part schematic view illustrating a state where the second guide unit according to the other modification of the first exemplary embodiment is in contact with the guide portion of the first guide unit.

Further, a second guide unit 3C illustrated in FIGS. 7A and 7B may also be applied to the transport guide device 1A according to the first exemplary embodiment.

The second guide unit 3C is divided into multiple (for example, four) guide unit segments 3C1, 3C2, 3C3, and 3C4 in a direction corresponding to the width direction K of the sheet-shaped object 9. The guide unit segments 3C1, 3C2, 3C3, and 3C4 are arranged at required intervals.

Further, each of the guide unit segments 3C1, 3C2, 3C3, and 3C4 includes the tip end protrusion **3*t*1 at the tip end of the respective one of the second end portions 3*c*. Each of the guide unit segments 3C1, 3C2, 3C3, and 3C4 includes lateral protrusions 3*p*1 and 3*p*2 at at least a part of lateral ends 3Ci and 3Cr thereof in the width direction K. The lateral protrusions 3*p*1 and 3*p*2 protrude in a direction away from the guide portion 2*g*. The respective lateral protrusions 3*p*1 and 3*p*2 are continuous with the tip end protrusion 3*t*1**.

At least a part of the lateral ends 3Ci and 3Cr is, for example, a portion including at least the most downwardly bent portion of the main body **3*a* of each of the guide unit segments 3C1, 3C2, 3C3, and 3C4 and portions before and after the most downwardly bent portion in the transport direction J. The lateral protrusions 3*p*1 and 3*p*2 may protrude to the same height as or a different height from the tip end protrusion 3*t*1**.

In this case, in each of the guide unit segments 3C1, 3C2, 3C3, and 3C4, (i) the tip end protrusion **3*t*1 may be changed to the tip end protrusion 3*t*2 including another member described above, (ii) the lateral protrusions 3*p*1 and 3*p*2 may be formed by bending a part of the lateral ends 3Ci and 3Cr of the main body 3*a*, or (iii) the lateral protrusions 3*p*1 and 3*p*2** may be the other members described above.

When the guide unit segments 3C1, 3C2, 3C3, and 3C4 each including the lateral protrusions **3*p*1 and 3*p*2 in addition to the tip end protrusion 3*t*2 are applied, the powder dust 101*a* peeled off from the respective guide unit segments 3C1, 3C2, 3C3, and 3C4 is blocked by the respective lateral protrusions 3*p*1 and 3*p*2 so as not to move to and fall from the lateral ends 3Ci and 3Cr, as compared with a case where the lateral protrusions 3*p*1 and 3*p*2** are not provided.

Thus, in each of the guide unit segments 3C1, 3C2, 3C3, and 3C4, the accumulated powder dust 101 is reliably prevented from being peeled off from the lateral ends 3Ci and 3Cr of each main body **3*a* in addition to the second end portion 3*c* of each main body 3*a***.

Second Exemplary Embodiment

Figure 8A:
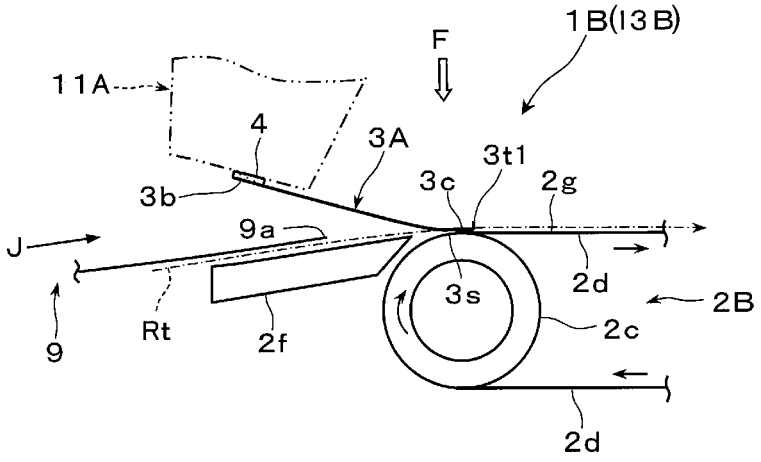
FIG. 8A is a side view conceptually illustrating a transport guide device according to a second exemplary embodiment.
Figure 8B:
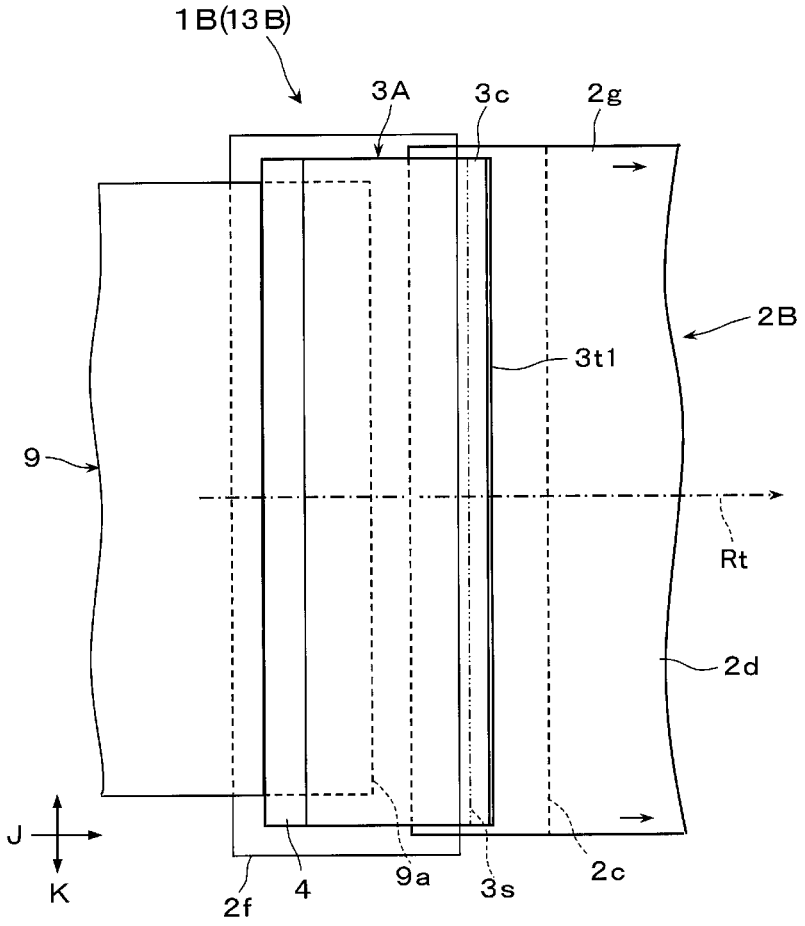
FIG. 8B is a plan view conceptually illustrating the transport guide device according to the second exemplary embodiment.

FIGS. 8A and 8B illustrate a transport guide device 1B according to a second exemplary embodiment of the present disclosure.

The transport guide device 1B has the same configuration as the transport guide device 1A according to the first exemplary embodiment except for that a first guide unit 2B including a rotating member which rotates to transport and guide the sheet-shaped object 9 along the transport path Rt is applied instead of the immovable first guide unit 2A.

The first guide unit 2B includes a rotating member which is rotatably disposed at a required position in the transport path Rt along which the sheet-shaped object 9 is transported. The first guide unit 2B is a so-called movable first guide unit. An endless transport belt **2*d* is used as the rotating member. The endless transport belt 2*d* is wound around multiple support rollers 2*c* and rotates in a direction along the transport direction J of the sheet-shaped object 9. The endless transport belt 2*d* transports the sheet-shaped object 9 by holding and supporting the sheet-shaped object 9 on the outer peripheral surface thereof. The guide portion 2*g* of the transport belt 2*d* which is an example of the rotating member is a portion of the outer peripheral surface of the transport belt moving along the transport path Rt in a state of being supported by the multiple support rollers 2*c*** to face upward.

In the second guide unit 3A including the tip end protrusion **3*t*1 in the transport guide device 1B, as illustrated in FIGS. 8A and 8B, the second end portion 3*c* thereof approaches, toward the downstream side in the transport direction J of the sheet-shaped object 9, a portion of the rotating member corresponding to a position to which the sheet-shaped object 9 is introduced and then contacts with the portion of the rotating member. The portion of the rotating member corresponding to the position to which the sheet-shaped object 9 is introduced is, for example, a portion (outer peripheral surface portion) of the transport belt 2*d* wound around the uppermost portion of the support rollers 2*c* disposed on an upstream side in the transport direction J. Further, the transport guide device 1B includes an introduction guide member 2*f* that guides the sheet-shaped object 9 into the space between the transport belt 2*d* as the rotating member and the second guide unit 3A. The introduction guide member 2*f*, for example, guides the leading end 9*a* of the sheet-shaped object 9 in transport such that leading end 9*a* of the sheet-shaped object 9 comes into contact with a part of the guide surface 3*f* of the second guide unit 3**A.

This transport guide device 1B guides and transports the sheet-shaped object 9 to be transported, as described below.

First, in the transport guide device 1B, as illustrated in FIG. 8A, when the sheet-shaped object 9 is transported from the upstream side of the transport path Rt in the transport direction J by the transport force of a transport device (not illustrated), the leading end **9*a* of the sheet-shaped object 9 is guided by the introduction guide member 2*f*, and is introduced into the space between the guide portion 2*g* of the transport belt 2*d* which is the rotating member in the first guide unit 2B and the first end portion 3*b* of the second guide unit 3**A.

Subsequently, in the transport guide device 1B, a part of the introduced sheet-shaped object 9 such as the leading end **9*a* comes into contact with a part of the guide surface 3*f* which is the lower surface of the second guide unit 3A. Thereafter, the second guide unit 3A guides a part of the sheet-shaped object 9 such as the leading end 9*a* so as to proceed along the guide surface 3*f* and then finally come into contact with the guide portion 2*g* of the transport belt 2*d*** which is the rotating member.

After that, in the transport guide device 1B, the second guide unit 3A continuously presses the sheet-shaped object 9 with the required force F against the guide portion **2*g* which is the outer peripheral surface of the transport belt 2*d* moving while being supported so as to be wound around the rotating support rollers 2*c*. Thus, the sheet-shaped object 9 proceeds in contact with the guide portion 2*g* which is the outer peripheral surface of the transport belt 2*d* while receiving the pressing force F from the second guide unit 3**A.

As described above, in the transport guide device 1B, the sheet-shaped object 9 is guided to proceed so as to substantially come into contact with the guide portion (outer peripheral surface) **2*g* of the transport belt 2*d* which is the rotating member of the first guide unit 2B at a position where it passes through at least the second end portion 3*c* of the second guide unit 3A. Thus, the sheet-shaped object 9 passes in contact with the guide portion 2*g* of the transport belt 2*d*, so that it is held and supported by the outer peripheral surface of the transport belt 2*d*** and is transported substantially along the transport path Rt.

Further, in the transport guide device 1B, even when a part of the powder dust 101 accumulated on the upper surface **3*d* of the second guide unit 3A is peeled off as described above during the transport of the sheet-shaped object 9, the peeled-off powder dust 101***a* is blocked by (the rising surface 3*k* of) the tip end protrusion 3*t*1 when moving to the tip end 3*ce* side of the second end portion 3*c* of the second guide unit 3A.

Therefore, even with the transport guide device 1B, a part of the powder dust 101 accumulated on the upper surface 3*d* of the second guide unit 3A is prevented from being peeled off and contaminating the sheet-shaped object 9, as compared with a case where the second guide unit 300 including no tip end protrusion 3*t*1 described above is applied. Moreover, in the transport guide device 1B, a part of the powder dust 101 accumulated on the upper surface 3*d* of the second guide unit 3A is prevented from being peeled off and contaminating the outer peripheral surface of the transport belt 2*d* which is the rotating member.

Modifications of Second Exemplary Embodiment

Figure 9A:
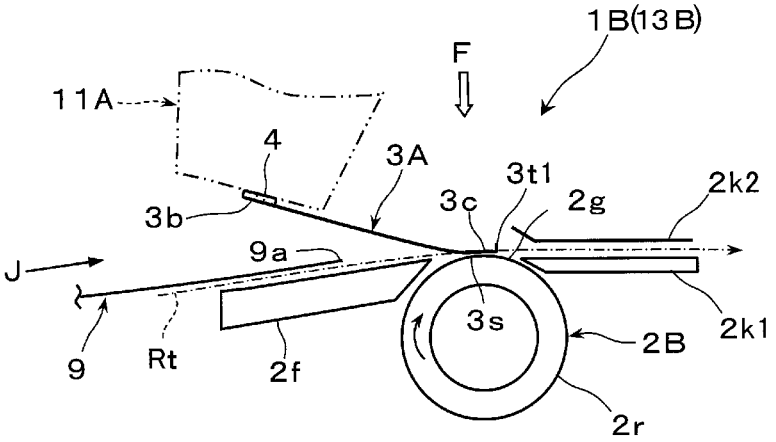
FIG. 9A is a side view conceptually illustrating a transport guide device according to a modification of the second exemplary embodiment.
Figure 9B:
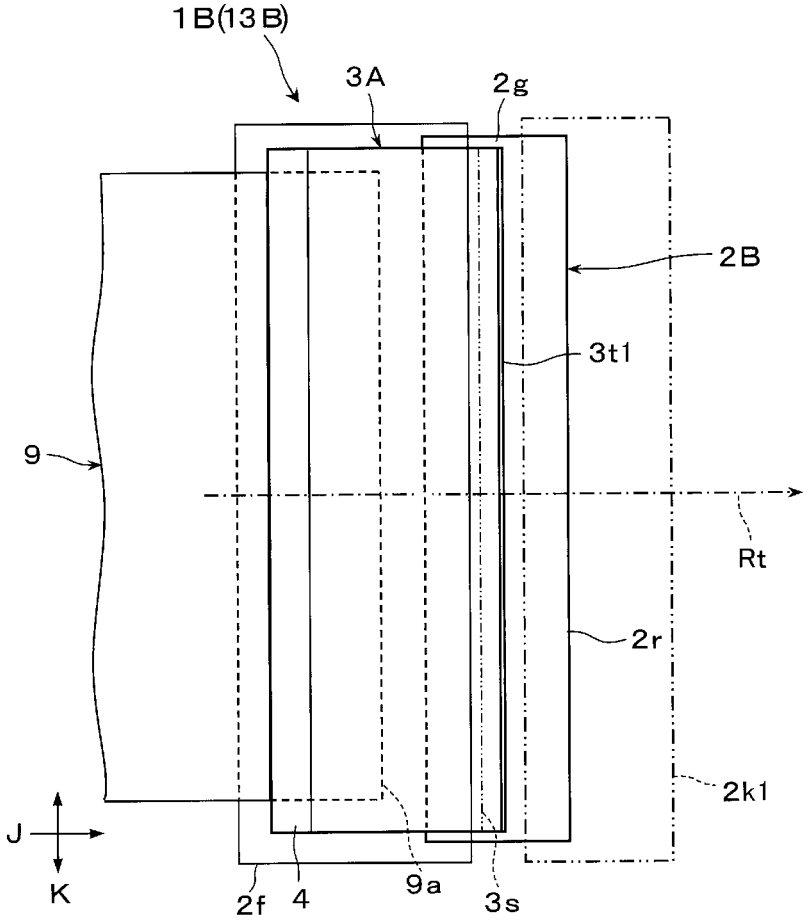
FIG. 9B is a plan view conceptually illustrating the transport guide device according to the modification of the second exemplary embodiment.

As illustrated in FIGS. 9A and 9B, the transport guide device 1B may adopt a rotating member including a transport roller 2*r* which is disposed at a required position in the transport path Rt along which the sheet-shaped object 9 is transported and which rotates to transport the sheet-shaped object 9, instead of the transport belt 2*d* which is the rotating member of the first guide unit 2B.

The transport roller 2*r* which is an example of the rotating member uses a rotationally driven roller which rotates in a direction along the transport direction J of the sheet-shaped object 9 to transport the sheet-shaped object 9 by holding and supporting the sheet-shaped object 9 on the outer peripheral surface thereof. The guide portion 2*g* of the transport roller 2*r* which is the rotating member is, for example, the uppermost portion of the outer peripheral surface of the transport roller 2*r*.

Further, as illustrated in FIGS. 9A and 9B, in the second guide unit 3A including the tip end protrusion 3*t*1 in the transport guide device 1B to which the transport roller 2*r* which is the rotating member is applied, the second end portion 3*c* thereof approaches, toward the downstream side in the transport direction J of the sheet-shaped object 9, a portion of the transport roller 2*r* serving as the rotating member corresponding to the position to which the sheet-shaped object 9 is introduced and then contacts with the portion of the transport roller 2*r*. The portion of the transport roller 2*r* corresponding to the position to which the sheet-shaped object 9 is introduced is, for example, the uppermost portion of the outer peripheral surface of the transport roller 2*r*.

Further, in addition to the introduction guide member 2*f*, the transport guide device 1B includes a discharge guide member 2*k* which guides the sheet-shaped object 9 carried out from the transport roller 2*r* serving as a rotating member. For example, a pair of upper and lower discharge guide members 2*k*1 and 2*k*2 is provided as the discharge guide member 2*k*. The upper and lower discharge guide members 2*k*1 and 2*k*2 are vertically arranged at an interval so as to form a guide space along the transport path Rt for the sheet-shaped object 9 after being discharged from the transport roller 2*r*.

In the transport guide device 1B to which the rotating member including the transport roller 2*r* is applied, the sheet-shaped object 9 to be transported is guided and transported in substantially the same manner as in the transport guide device 1B described above.

That is, also in the transport guide device 1B, the sheet-shaped object 9 is guided to proceed so as to substantially come into contact with the guide portion (uppermost outer peripheral surface) 2*g* of the transport roller 2*r* which is the rotating member of the first guide unit 2B at a position where it passes through at least the second end portion 3*c* of the second guide unit 3A. Thus, the sheet-shaped object 9 passes in contact with and is held and supported by the guide portion 2*g* of the transport roller 2*r*, and is transported substantially along the transport path Rt. Further, the sheet-shaped object 9 is guided by the discharge guide members 2*k*1 and 2*k*2 and continues to be transported substantially along the transport path Rt even after being discharged from the transport roller 2*r*.

Further, also in this transport guide device 1B, even when a part of the powder dust 101 accumulated on the upper surface 3*d* of the second guide unit 3A is peeled off as described above during the transport of the sheet-shaped object 9, the peeled-off powder dust 101*a* is blocked by (the rising surface 3*k* of) the tip end protrusion 3*t*1 when moving to the tip end 3*ce* side of the second end portion 3*c* of the second guide unit 3A.

Therefore, even with the transport guide device 1B, a part of the powder dust 101 accumulated on the upper surface 3*d* of the second guide unit 3A is prevented from being peeled off and contaminating the sheet-shaped object 9, as compared with a case where the second guide unit 300 including no tip end protrusion 3*t*1 described above is applied. Moreover, in the transport guide device 1B, a part of the powder dust 101 accumulated on the upper surface 3*d* of the second guide unit 3A is prevented from being peeled off and contaminating the outer peripheral surface of the transport roller 2*r* which is the rotating member.

Further, in both the transport guide devices 1B which adopt the above-described two types of movable first guide units 2B, instead of the second guide unit 3A, the second guide unit 3B including the tip end protrusion 3*t*2 illustrated in the modification of the first exemplary embodiment may be applied, or the multiple guide unit segments 3C1, 3C2, 3C3, and 3C4 each including the tip end protrusion 3*t* and the lateral protrusions 3*p*1 and 3*p*2 illustrated in the modification may be applied.

Third Exemplary Embodiment

Figure 10:
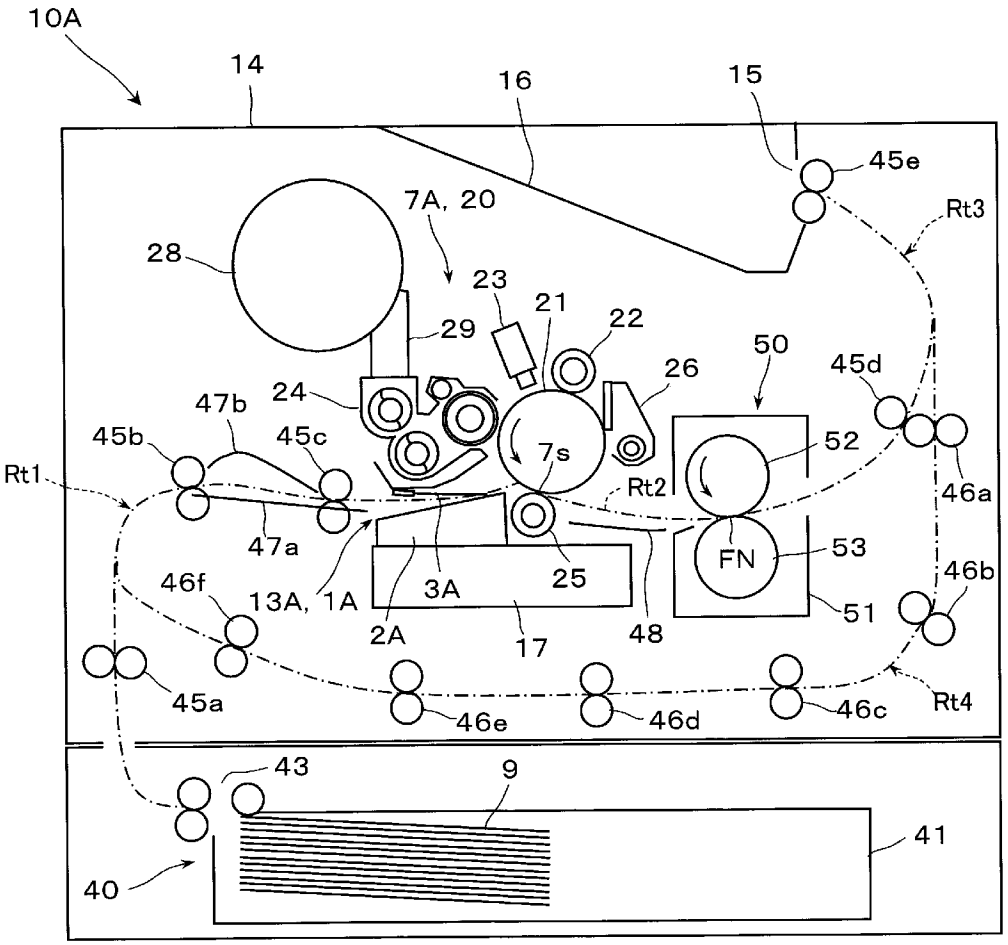
FIG. 10 is a schematic view illustrating an image forming apparatus which is an example of a powder using apparatus according to a third exemplary embodiment.

FIG. 10 illustrates a powder using apparatus 10 according to a third exemplary embodiment of the present disclosure.

The powder using apparatus 10 includes at least a powder adhering device 7 having a powder adhering portion 7*s* which causes powder to adhere to the sheet-shaped object 9, and a transport guide device 13 which guides the sheet-shaped object 9 along the transport path Rt that sends the powder to the powder adhering portion 7*s* of the powder adhering device 7.

Figure 11:
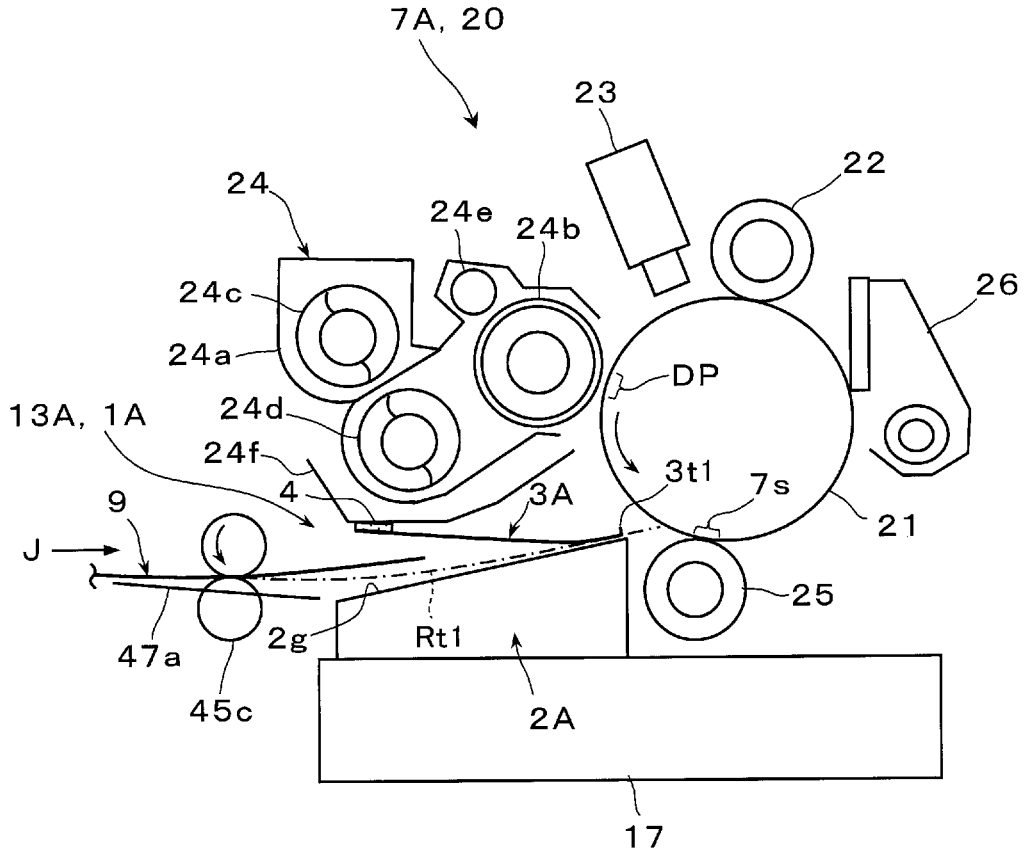
FIG. 11 is an enlarged schematic view illustrating an image forming device and a transport guide device in the image forming apparatus of FIG. 10.

As illustrated in FIG. 10 or 11, the powder using apparatus 10 according to the third exemplary embodiment is configured as an image forming apparatus 10A that forms an image by causing a developer (which is an example of the powder) to adhere to the sheet-shaped object 9 and fixing the developer to the sheet-shaped object 9.

In the image forming apparatus 10A, as the powder adhering device 7, an image forming device 20 having the powder adhering portion 7*s* is applied, which transfers a developer image developed with the developer by an electrophotographic method to the sheet-shaped object 9 and causes the developer image to adhere to the sheet-shaped object 9. Further, in the image forming apparatus 10A, a transport guide device 13A is applied as the transport guide device 13. The transport guide device 13A is a device that is disposed on a portion which sends the sheet-shaped object 9 to the powder adhering portion 7*s* of the image forming device 20 and that includes the transport guide device 1A according to the first exemplary embodiment as described below.

As illustrated in FIG. 10, the image forming apparatus 10A, which is an example of the powder using apparatus 10, includes a housing 14 having a required external appearance shape. The image forming apparatus 10A includes devices such as the image forming device 20 which is an example of the powder adhering device 7, a sheet-shaped object supply device 40, and a fixing device 50 in the internal space of the housing 14.

The one dot dash line in FIG. 10 indicates a main transport path when the sheet-shaped object 9 is transported in the housing 14. The sheet-shaped object 9 may simply be a sheet-shaped recording medium that is able to be transported in the housing 14 and enables the transfer-adherence and heat-fixing of the developer image. The sheet-shaped object 9 is not particularly limited as to the material and shape thereof. For example, a recording paper, thick paper, or envelope that is cut or formed into a predetermined size is applied as the sheet-shaped object 9.

The image forming device 20 includes a photoconductive drum 21 which rotates in the direction indicated by the arrow. Devices such as a charging device 22, an exposure device 23, a developing device 24, a transfer device 25, and a cleaning device 26 are disposed around the photoconductive drum 21.

The photoconductive drum 21 is an example of an image carrier, and is a photoconductor in the form of a drum having a photoconductive layer. The charging device 22 is a device that charges the outer peripheral surface (image forming surface) of the photoconductive drum 21 to a required surface potential. As the charging device 22, for example, a contact type charging device is applied which has a charging member in the form of a roller which comes into contact with the image forming surface as the outer peripheral surface of the photoconductive drum 21 and to which a required charging current is supplied from a power feeding device (not illustrated).

The exposure device 23 is a device that forms an electrostatic latent image by exposing the outer peripheral surface of the photoconductive drum 21 based on image information after charging. For example, a light emitting diode (LED) recording head is used as the exposure device 23. The LED recording head includes LEDs arranged in a row substantially along a main scanning direction. The exposure device 23 operates upon receiving an image signal generated when required processing is performed on image information input from the outside by a component such as an image processing circuit (not illustrated). The image information is, for example, information related to an image to be formed such as characters, figures, photographs, and patterns.

The developing device 24 is a device that develops the electrostatic latent image formed on the outer peripheral surface of the photoconductive drum 21 with a developer (toner) of a predetermined color (for example, black) to create a monochromatic toner image. As illustrated in FIG. 11, the developing device 24 includes a developing roller 24*b*, agitation transport members 24*c* and 24*d*, and an adjustment member 24*e* in a main body 24*a* having a container shape. The developing roller 24*b* carries a developer and performs developing. The agitation transport members 24*c* and 24*d* agitate and transport the developer accommodated in the main body 24*a*. The adjustment member 24*e* adjusts the amount (layer thickness) of the developer carried on the developing roller 24*b*. For example, a two-component developer containing a non-magnetic toner and a magnetic carrier is used as the developer. A portion of the photoconductive drum 21 that the developing roller 24*b* approaches and faces is a developing portion DP.

The developing device 24 is provided in a lower surface portion of the main body 24*a* with a ventilation path plate 24*f* forming a ventilation space through which air of the air flow passes. Further, the main body 24*a* of the developing device 24 is replenished with a replenishment developer (toner) accommodated in a replenishment container 28 which is detachably mounted in the housing 14. A replenishment transport device 29 replenishes a required amount of the developer at a required timing.

The transfer device 25 is a device that electrostatically transfers the developer image (toner image) which is formed on the outer peripheral surface of the photoconductive drum 21 by developing to the sheet-shaped object 9. For example, a contact type transfer device is used as the transfer device 25. The contact type transfer device has a transfer member in the form of a roller which comes into contact with the outer peripheral surface of the photoconductive drum 21 and to which a required transfer current is supplied from the power feeding device (not illustrated).

The cleaning device 26 is a device that cleans the outer peripheral surface of the photoconductive drum 21 by removing unnecessary substances such as an unnecessary toner and paper dust adhering to the outer peripheral surface of the photoconductive drum 21. For example, a blade type cleaning device is used as the cleaning device 26. The cleaning device 26 includes a cleaning blade which comes into contact with the outer peripheral surface of the photoconductive drum 21 and scrapes off unnecessary substances, a transport member which transports deposits scraped off by the cleaning blade so as to be collected into a recovery portion such as a recovery container (not illustrated).

In the image forming device 20, a portion where the photoconductive drum 21 and the transfer device 25 face each other is a transfer position where the developer image is transferred, and also serves as the powder adhering portion 7*s* that causes the developer (which is an example of the powder) to adhere to the sheet-shaped object 9.

The sheet-shaped object supply device 40 is a device that accommodates and delivers the sheet-shaped object 9 to be supplied to the powder adhering portion 7*s* which is the transfer position in the image forming device 20. The sheet-shaped object supply device 40 includes, for example, devices such as a single or multiple accommodating bodies 41 which accommodate the sheet-shaped object 9 and a single or multiple delivery devices 43 which deliver the sheet-shaped object 9.

The fixing device 50 is a device that heats and pressurizes the unfixed developer image transferred to and adhering to the powder adhering portion 7*s* of the image forming device 20 in order to fix the developer image to the sheet-shaped object 9. The fixing device 50 includes devices such as a heating rotator 52 and a pressurizing rotator 53 in the internal space of the housing 51 including an introduction port and a discharge port for the sheet-shaped object 9.

Further, in the fixing device 50, the heating rotator 52 and the pressurizing rotator 53 rotate in contact with each other. The heating rotator 52 and the pressurizing rotator 53 heat and pressurize the sheet-shaped object 9 passing through the contact portion (fixing processing portion FN) therebetween. The heating rotator 52 and the pressurizing rotator 53 are configured in a required form such as a roller form or a belt nip form.

As illustrated in FIG. 10, the image forming apparatus 10A includes a supply transport path Rt1 along which the sheet-shaped object 9 delivered from the sheet-shaped object supply device 40 is transported and supplied to the powder adhering portion 7*s* of the image forming device 20. The supply transport path Rt1 includes multiple transport rollers 45*a*, 45*b*, and 45*c* which sandwich and transport the sheet-shaped object 9, and multiple guide members 47*a* and 47*b* and the transport guide device 13A which secure a transport space for the sheet-shaped object 9 to guide and transport the sheet-shaped object 9. The transport roller 45*c* operates so as to temporarily stop the sheet-shaped object 9 and then send the sheet-shaped object 9 toward the powder adhering portion 7*s* at a required timing.

Further, the image forming apparatus 10 includes a relay transport path Rt2 along which the sheet-shaped object 9 on which the developer image has been transferred and adhered is transported from the powder adhering portion 7*s* of the image forming device 20 to the fixing processing portion FN of the fixing device 50. The relay transport path Rt2 includes a guide member 48 which guides and transports the sheet-shaped object 9 from below.

Further, the image forming apparatus 10 includes a discharge transport path Rt3 along which the sheet-shaped object 9 discharged from the fixing device 50 after fixing is transported to the transport roller 45*e* which is a discharge roller provided at a discharge port 15 formed in a part of the housing 14 and is discharged to a discharge accommodating unit 16 provided in the upper region of the housing 14. The discharge transport path Rt3 includes multiple transport rollers 45*d* and 45*e* which sandwich and transport the sheet-shaped object 9, and multiple guide members (not illustrated) which secure a transport space for the sheet-shaped object 9 and guide and transport the sheet-shaped object 9.

Further, the image forming apparatus 10 includes a re-delivery transport path Rt4. When images are formed on both front and rear surfaces of the sheet-shaped object 9, the re-delivery transport path Rt4 pulls the trailing end of the sheet-shaped object 9 having an image formed on a first surface (a front surface or a back surface) and transports the sheet-shaped object 9 from a position in the middle of the discharge transport path Rt3 to the inner lower side of the housing 14 by a switchback method including a course change member (not illustrated), and then re-delivers the sheet-shaped object 9 so as to send the sheet-shaped object 9 again from a position in the middle of the supply transport path Rt1 to the powder adhering portion 7*s* of the image forming device 20. The re-delivery transport path Rt4 includes multiple transport rollers 46*a* to 46*f* which sandwich and transport the sheet-shaped object 9, and multiple guide members (not illustrated) which secure a transport space for the sheet-shaped object 9 and guide and transport the sheet-shaped object 9.

In the image forming apparatus 10A, the developing device 24 is detachably mounted to a mounting portion (not illustrated) of the housing 14 for the developing device 24. In the image forming apparatus 10A, the developing device 24 to which other devices such as the photoconductive drum 21, the charging device 22, and the cleaning device 26 are integrated may be detachably mounted.

Further, in the image forming apparatus 10A, as illustrated in FIG. 11, the transport guide device 13A is provided at the most downstream position of the supply transport path Rt1 and also in front of the powder adhering portion 7*s* of the image forming device 20 to guide the sheet-shaped object 9 along the supply transport path Rt1 along which the sheet-shaped object 9 is sent to the powder adhering portion 7*s* of the image forming device 20. Further, in the image forming apparatus 10A, the transport guide device 13A includes the transport guide device 1A (see, for example, FIGS. 1A and 1B) according to the first exemplary embodiment.

As illustrated in FIG. 11, in the transport guide device 13A, the first guide unit 2A of the transport guide device 1A according to the first exemplary embodiment including the guide portion 2*g* that guides the sheet-shaped object 9 along the supply transport path Rt1 is fixed between the transport roller 45*c* in the supply transport path Rt1 and the powder adhering portion 7*s* of the image forming device 20, and the second guide unit 3A of the transport guide device 1A according to the first exemplary embodiment guides the sheet-shaped object 9 such that the sheet-shaped object 9 comes into contact with the guide portion 2*g* of the first guide unit 2A.

The main body 2*a* of the first guide unit 2A in the transport guide device 13A is fixed to a support member 17 which supports the transfer device 25. The guide portion 2*g* is disposed below the developing device 24 so as to face the developing device 24 with a space therebetween.

For example, the guide portion 2*g* includes an inclined surface which gradually rises at the inclination angle β (see FIG. 3B) toward the downstream side in the transport direction J of the sheet-shaped object 9, and the multiple elongated projections 2*gr* (see FIG. 1B) formed on the inclined surface, so as to guide the transport of the sheet-shaped object 9 along the supply transport path Rt1 which abuts against the outer peripheral surface of the photoconductive drum 21 slightly upstream of the powder adhering portion 7*s* on the rotational direction.

In the second guide unit 3A of the transport guide device 13A, the first end portion 3*b* of the main body 3*a* is fixed to the ventilation path plate 24*f* of the developing device 24 by the fixing unit 4, whereas the second end portion 3*c* thereof gradually approaches the guide portion 2*g* of the first guide unit 2A toward the downstream side in the transport direction J and contacts with the guide portion 2*g* of the first guide unit 2A at an acute intersection angle.

Further, in the second guide unit 3A, the tip end 3*ce* of the second end portion 3*c* at which the tip end protrusion 3*t*1 is disposed protrudes from the downstream end portion 2*ge* of the guide portion 2*g* (FIG. 3B). Further, in the second guide unit 3A, the tip end protrusion 3*t*1 is located at a position slightly closer to the powder adhering portion 7*s* than a position directly below, along the gravity direction G, the developing portion DP where the developing roller 24*b* of the developing device 24 faces the photoconductive drum 21.

The developing device 24 to which the first end portion 3*b* of the second guide unit 3A is fixed is the attachment target 11 of the second guide unit 3A. In particular, since the developing device 24 is configured to be detachably mounted to the housing 14 as described above, the developing device 24 is the replaceable attachment target 11B corresponding to a component (including a device) that is replaced at a required timing.

The image forming apparatus 10A performs formation of an image, for example, as follows.

That is, in the image forming apparatus 10A, when a controller (not illustrated) receives a command for an operation of forming an image, the electrophotographic image forming device 20 executes a charging operation, an exposure operation, a developing operation, and a transfer operation, and the sheet-shaped object supply device 40 executes an operation of delivering the sheet-shaped object 9 and transporting the sheet-shaped object 9 via the supply transport path Rt1 and the transport guide device 13A so as to send the sheet-shaped object 9 to the powder adhering portion 7*s* of the image forming apparatus 20.

Thus, a developer image corresponding to image information is formed on the photoconductive drum 21, and is transferred to and is caused to adhere to the sheet-shaped object 9 supplied to the powder adhering portion 7*s* between the photoconductive drum 21 and the transfer device 25. Further, at this time, the sheet-shaped object 9 to which the developer image has been transferred and adhered is peeled off from the photoconductive drum 21 in a state of being sandwiched between the rotating photoconductive drum 21 and the transfer device 25, and is delivered toward the fixing device 50 via the relay transport path Rt2.

Subsequently, in the image forming apparatus 10A, the fixing device 50 executes a fixing operation of heating and pressurizing the sheet-shaped object 9 to which the developer image has been transferred and adhered when the sheet-shaped object 9 is introduced into and passes through the fixing processing portion FN.

The sheet-shaped object 9 after fixing is transported to the discharge port 15 via the discharge transport path Rt3, and is finally delivered to and accommodated in the discharge accommodating unit 16 in the upper region of the housing 14 by the transport roller 45*e* which is a discharge roller.

As described above, the basic image forming operation of the image forming apparatus 10A of forming an image made of a monochromatic developer on one surface of one sheet-shaped object 9 is completed.

Further, in the image forming apparatus 10A, when forming images on both surfaces of the sheet-shaped object 9, the sheet-shaped object 9 having the image formed on one surface is again transported to the supply transport path Rt1 via the re-delivery transport path Rt4, and is then sent to the powder adhering portion 7*s* of the image forming device 20, whereby an image is formed on the other surface of the sheet-shaped object 9.

Further, in the image forming apparatus 10A, the transport guide device 13A guides the transport of the sheet-shaped object 9 as in the case of the first exemplary embodiment, and finally, the sheet-shaped object 9 is guided to proceed so as to substantially come into contact with the guide portion 2*g* of the first guide unit 2A at a position where it passes through at least the second end portion 3*c* of the second guide unit 3A.

Thus, the sheet-shaped object 9 is smoothly transported toward the powder adhering portion 7*s* which is the transfer position of the image forming device 20 substantially along the supply transport path Rt1 as it passes in contact with the guide portion 2*g*.

Figure 12:
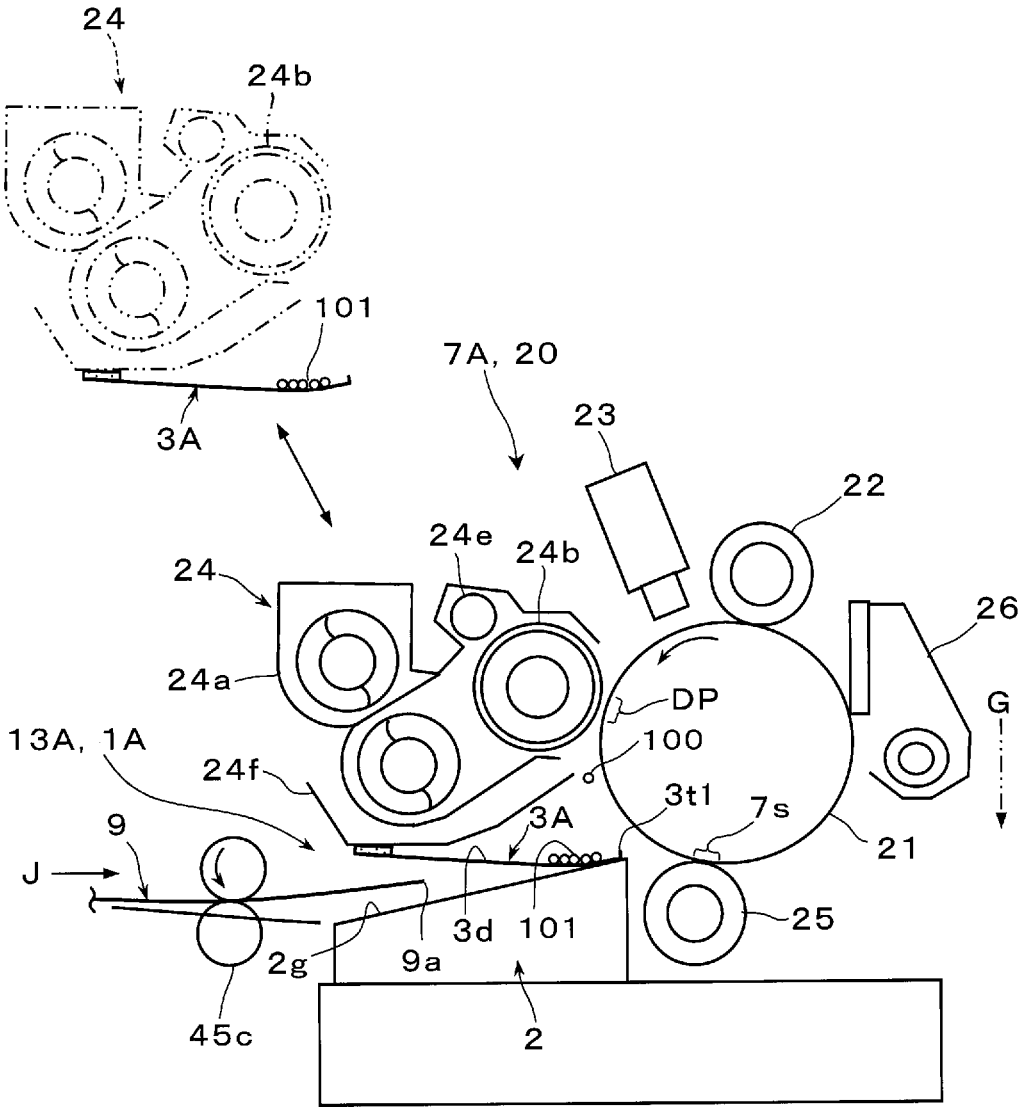
FIG. 12 is an enlarged schematic view illustrating a state where powder dust is accumulated on a second guide unit of the transport guide device in the image forming apparatus of FIG. 10 and the prevention effects thereof.

In the meantime, in the image forming apparatus 10A to which such a transport guide device 13A (1A) is applied, as illustrated in FIG. 12, the powder dust 100 including the developer which is an example of the powder in the developing portion DP of the developing device 24 on the photoconductive drum 21 floats near the transport guide device 13A, and a part 101 of the powder dust 100 falls due to gravity, thus adhering to and being gradually accumulated on the upper surface 3*d* of the second guide unit 3A (see FIG. 5A).

Further, also in this image forming apparatus 10A, a part of the accumulated powder dust 101 may be peeled off due to an impact received when a part of the sheet-shaped object 9 to be transported such as the leading end 9*a* comes into contact with the guide surface 3*f* of the second guide unit 3A (see FIG. 5B).

However, in this image forming apparatus 10A, since the transport guide device 13A adopts the second guide unit 3A including the tip end protrusion 3*t*1, even when a part of the powder dust 101 accumulated on the upper surface 3*d* of the second guide unit 3A is peeled off as described above during the transport of the sheet-shaped object 9, the peeled-off powder dust 101*a* is blocked by (the rising surface 3*k* of) the tip end protrusion 3*t*1 when moving to the tip end 3*ce* side of the second end portion 3*c* of the second guide unit 3A.

Therefore, according to the image forming apparatus 10A which is an example of the powder using apparatus 10, a part of the powder dust 101 accumulated on the upper surface 3*d* of the second guide unit 3A in the transport guide device 13A is prevented from being peeled off and contaminating the sheet-shaped object 9, as compared with a case where the second guide unit 300 including no tip end protrusion 3*t*1 (see FIGS. 5A and 5B) is applied. As a result, in the image forming apparatus 10A, the occurrence of image defects due to the contamination of the sheet-shaped object 9 is prevented, as compared with a case where the transport guide device 13A is not applied.

Further, in the image forming apparatus 10A, the second guide unit 3A of the transport guide device 13A is fixed to a portion (ventilation path plate 24*f*) of the developing device 24 (which is an example of the replaceable attachment target 11B) opposing the second guide unit 3A across the supply transport path Rt1. Therefore, as illustrated by the two dots dash line in FIG. 12, when the developing device 24 is removed from the housing 14 for replacement, the second guide unit 3A is also removed from the image forming device 10A along with the developing device 24.

Thus, the image forming apparatus 10A may prevent the risk of a large amount of the powder dust 101 being accumulated on the second guide unit 3A by replacing the developing device 24, as compared with a case where the second guide unit 3A is not fixed to the replaceable attachment target 11B.

Modifications of Third Exemplary Embodiment

In the image forming apparatus 10A, instead of the transport guide device 13A using the second guide unit 3A, the transport guide device 13A using the second guide unit 3B including the tip end protrusion 3*t*2 illustrated in the modification of the first exemplary embodiment may be applied as the transport guide device 13, or the transport guide device 13A using the multiple guide unit segments 3C1, 3C2, 3C3, and 3C4 each including the tip end protrusion 3*t* and the lateral protrusion 3*p*1 and 3*p*2 illustrated in the modification may be applied as the transport guide device 13.

Further, in the image forming apparatus 10A, instead of the transport guide device 13A using the fixed first guide unit 2A, the transport guide device 13B using the movable first guide unit 2B (see FIGS. 8A, 8B, 9A, and 9B) according to the second exemplary embodiment may also be applied as the transport guide device 13. The transport guide device 13B adopting the movable first guide unit 2B using the transport belt 2*d* illustrated in FIGS. 8A and 8B configures a portion by which the sheet-shaped object 9 begins to be held and supported on the transport belt 2*d* in a transfer/transport belt device which transports the sheet-shaped object 9 to the powder adhering portion 7*s* of the image forming device 20 by the transport belt 2*d*.

Further, the image forming apparatus 10A which is an example of the powder using apparatus 10 is not particularly limited as long as such an apparatus is an image forming apparatus to which the transport guide devices 13A and 13B may be applied. For example, the image forming apparatus 10A may be an image forming apparatus of forming a multicolor (color) image made of multiple colors of developers.

Fourth Exemplary Embodiment

Figure 13:
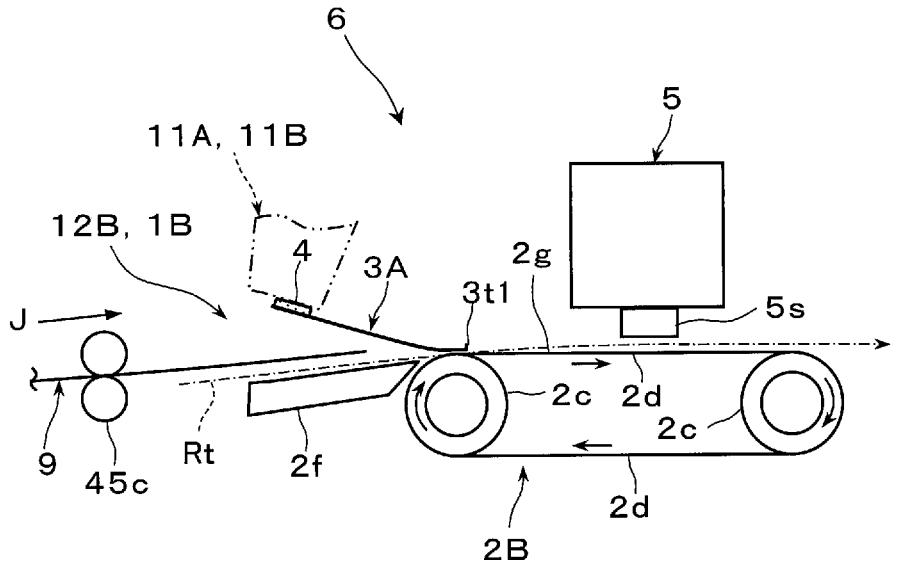
FIG. 13 is a schematic view illustrating an example of a sheet-shaped object processing apparatus according to a fourth exemplary embodiment.

FIG. 13 illustrates the sheet-shaped object processing apparatus 6 according to a fourth exemplary embodiment of the present disclosure.

The sheet-shaped object processing apparatus 6 includes at least a processing device 5 having a processing unit 5*s* which executes a processing on the sheet-shaped object 9, and the transport guide device 12 which guides the sheet-shaped object 9 along the transport path Rt along which the sheet-shaped object 9 is sent to the processing unit 5*s* of the processing device 5.

The sheet-shaped object processing apparatus 6 according to the fourth exemplary embodiment is configured as an image recording apparatus that forms an image by adhering ink to the sheet-shaped object 9.

In the image recording apparatus which is an example of the sheet-shaped object processing apparatus 6, an ink ejection device is used as the processing device 5. The ink ejection device has, for example, the processing unit 5*s* including a recording head which ejects ink droplets onto the sheet-shaped object 9 in response to image information input from the outside. Further, in the image recording apparatus, the transport guide device 12B including the movable transport guide device 1B according to the second exemplary embodiment is applied as the transport guide device 12. The transport guide device 12B is disposed at a portion where the sheet-shaped object 9 is sent to the processing unit 5*s* of the ink ejection device which is an example of the processing device 5.

Further, in this image recording apparatus, as illustrated in FIG. 13, the transport guide device 12B is provided at the most downstream position of the transport path Rt of the sheet-shaped object 9 and also in front of the powder adhering portion 7*s* of the image forming device 20 to guide the sheet-shaped object 9 along the transport path Rt along which the sheet-shaped object 9 is sent to the processing unit 5*s* of the ink ejection device. Further, in the image recording apparatus, the transport guide device 12B includes the transport guide device 2B (see, for example, FIGS. 8A and 8B) according to the second exemplary embodiment.

As illustrated in FIG. 13, in the transport guide device 12B, the movable first guide unit 2B of the transport guide device 1B according to the second exemplary embodiment including the guide portion 2*g* that guides the sheet-shaped object 9 along the transport path Rt is disposed between the transport roller 45*c* which transports the sheet-shaped object 9 to be delivered at a predetermined timing in the transport path Rt and the processing unit 5*s* of the ink ejection device, and the second guide unit 3A (see, for example, FIGS. 8A and 8B) of the transport guide device 1B according to the second exemplary embodiment guides the sheet-shaped object 9 such that the sheet-shaped object 9 comes into contact with the guide portion 2*g* of the first guide unit 2B.

The movable first guide unit 2B of the transport guide device 12B is, for example, a belt transport device configured to be wound around two support rollers 2*c* and 2*c* and rotate in a direction along the transport direction J of the sheet-shaped object 9 so that the transport belt 2*d* passes below the processing unit 5*s* of the ink ejection device.

The guide portion 2*g* is an outer peripheral surface portion of the transport belt 2*d* which faces upward, and is configured to transport and guide the sheet-shaped object 9 along the transport path Rt along which the sheet-shaped object 9 is sent to reach and pass through the lower side of the processing unit 5*s* of the ink ejection device.

In the second guide unit 3A of the transport guide device 12B, the first end portion 3*b* of the main body 3*a* is fixed by the fixing unit 4 to the fixed or replaceable attachment target 11A or 11B disposed near the transport guide device 12B, whereas the second end portion 3*c* thereof gradually approaches the outer peripheral surface of the transport belt 2*d*, which is the guide portion 2*g* of the first guide unit 2B, toward downstream side in the transport direction J and contacts with the outer peripheral surface of the transport belt 2*d* at an acute intersection angle.

The image recording apparatus which is an example of the sheet-shaped object processing apparatus 6 performs recording of an image, for example, as follows.

That is, in the image recording apparatus, when a controller (not illustrated) receives a command for an operation of recording an image, after the sheet-shaped object 9 delivered from a device (not illustrated) which accommodates and supplies the sheet-shaped object 9 is transported along the transport path Rt, the sheet-shaped object 9 is delivered at a predetermined timing by the transport roller 45*c* and is guided to be transported by the transport guide device 12B. After that, the sheet-shaped object 9 is transported in a state of being held and supported by the transport belt 2*d* of the movable first guide unit 2B. Thus, the sheet-shaped object 9 is sent to the processing unit 5*s* including a printing head of the ink ejection device which is an example of the processing device 5.

In the meantime, in the image recording apparatus, the ink droplets corresponding to image information are ejected from the processing unit 5*s* including the printing head of the ink ejection device toward the sheet-shaped object 9.

Subsequently, in the image recording apparatus, the sheet-shaped object 9 on which the image formed of ink droplets of the ink ejection device has been recorded is transported by the transport belt 2*d* of the first guide unit 2B, and is finally discharged to a discharge accommodating unit (not illustrated).

As described above, the basic image recording operation of the image recording apparatus which forms an image formed of ink droplets on one surface of one sheet-shaped object 9 is completed.

Further, in the image recording apparatus, the transport guide device 12B guides the transport of the sheet-shaped object 9 as in the case of the second exemplary embodiment, and finally, the sheet-shaped object 9 is guided to proceed so as to substantially come into contact with the outer peripheral surface of the transport belt 2*d* which is the guide portion 2*g* of the first guide unit 2B at a position where the sheet-shaped object 9 passes through at least the second end portion 3*c* of the second guide unit 3A.

Thus, the sheet-shaped object 9 is smoothly transported to be sent to the processing unit 5*s* including the printing head of the ink ejection device substantially along the transport path Rt as it passes in contact with the guide portion 2*g*.

In the meantime, in the image recording apparatus which is an example of the sheet-shaped object processing apparatus 6 to which the transport guide device 12B (1B) is applied, the powder dust 100 including the powder near the transport guide device 12B floats, and a part 101 of the powder dust 100 falls due to gravity, thus adhering to and being gradually accumulated on the upper surface 3*d* of the second guide unit 3*a* (see FIG. 5A).

Further, also in this image recording apparatus, a part of the accumulated powder dust 101 is peeled off due to an impact received when a portion of the sheet-shaped object 9 to be transported such as the leading end 9*a* comes into contact with the guide surface 3*f* of the second guide unit 3A (see FIG. 5B).

However, in this image recording apparatus, since the transport guide device 12B adopts the second guide unit 3A including the tip end protrusion 3*t*1, even when a part of the powder dust 101 accumulated on the upper surface 3*d* of the second guide unit 3A is peeled off as described above during the transport of the sheet-shaped object 9, the peeled-off powder dust 101*a* is blocked by (the rising surface 3*k* of) the tip end protrusion 3*t*1 when moving to the tip end 3*ce* side of the second end portion 3*c* of the second guide unit 3A.

Therefore, according to this image recording apparatus, a part of the powder dust 101 accumulated on the upper surface 3*d* of the second guide unit 3A in the transport guide device 12B is prevented from being peeled off and contaminating the sheet-shaped object 9, as compared with a case where the second guide unit 300 including no tip end protrusion 3*t*1 (see FIGS. 5A and 5B) is applied. As a result, in this image recording apparatus, the occurrence of image defects due to the contamination of the sheet-shaped object 9 is prevented, as compared with a case where the transport guide device 12B is not applied.

Modifications of Fourth Exemplary Embodiment

In the fourth exemplary embodiment, instead of the movable transport guide device 12B, the transport guide device 12A including the immovable first guide unit 2A according to the first exemplary embodiment may be applied. In this case, for example, the first guide unit 2A may be configured to extend so that the guide portion 2*g* reaches and passes through the processing unit 5*s* of the ink ejection device.

Further, the sheet-shaped object processing apparatus 6 to which the transport guide device 12B is applied may be, for example, the following device in addition to the image recording apparatus.

That is, the sheet-shaped object processing apparatus 6 to which the transport guide device 12B is applied may be a drying apparatus which includes, as the processing device 5, a drying device having the processing unit 5*s* to blow hot air for drying the sheet-shaped object 9, an image recording apparatus which includes, as the processing device 5, a heat-sensitive recording device having the processing unit to perform heat-sensitive recording on the sheet-shaped object 9, a printing apparatus which includes, as the processing device 5, a rotation device having the processing unit 5*s* to perform ink printing on the sheet-shaped object 9, or a coating apparatus which includes, as the processing device 5, a coating device having the processing unit 5*s* to apply a liquid paint to the sheet-shaped object 9.

Modifications Other than Above Modifications

Described is the configuration example in which the surface constituting the guide portion 2*g* of the immovable first guide unit 2A in the transport guide device 1A according to the first exemplary embodiment is a flat surface. Alternatively, the surface may be, for example, a curved surface. Further, described is the configuration example in which the upper end portion (surface) of the elongated projections constituting the guide portion 2*g* is formed in a linearly extending shape. It is noted that the upper end portion (surface) may be formed, for example, in a curved shape in the transport direction J.

Further, described in the first exemplary embodiment is the case where the guide portion 2*g* of the immovable first guide unit 2A is the portion that is inclined at the required inclination angle θ to gradually rise. Alternatively, the guide portion 2*g* may also be a substantially horizontally extending portion or a downwardly inclined portion.

Described is the case where the second guide unit in which the main body 3*a* includes the sheet-shaped elastic member is applied as the second guide units 3A and 3B of the transport guide devices 1A and 1B. Alternatively, for example, when a highly rigid metal sheet is applied as the sheet-shaped object 9, a second guide unit in which the main body 3*a* includes a plate-shaped rigid member (for example, a member having a rigidity enough to be not elastically deformed and bent when attached) may be applied. The second guide unit having the main body 3*a* including the plate-shaped rigid member may be used by rotatably fixing the first end portion 3*b* of the main body 3*a*.

Further, for the second guide unit 3 represented by each of the second guide units 3A, 3B, and 3C, described is the case where the non-fixed second end portion 3*c* is in contact with the guide portion 2*g*. Alternatively, the second end portion 3*c* of the second guide unit 3 may approach the guide portion 2*g*. In this case, a gap between the second end portion 3*c* of the second guide unit 3 and the guide portion 2*g* may be, for example, a gap within the range in which the guide action of the second guide unit 3 has an effect on the sheet-shaped object 9.

In addition, in the second guide unit 3 represented by each of the second guide units 3A, 3B, and 3C, the guide surface 3*f* may be subjected to roughening. When the second guide unit 3 having the roughened guide surface 3*f* is applied, the contact area thereof with the sheet-shaped object 9 which moves in contact with the guide surface 3*f* is reduced, which reduces the occurrence of triboelectric charging and makes it easier to implement smooth guide, as compared with a case where the second guide unit 3 in which the guide surface 3*f* is not roughened is applied.

Further, the powder using apparatus 10 according to the third exemplary embodiment may be, for example, a powder coating apparatus that uses the developer according to the third exemplary embodiment as coating powder.

Specifically, the powder coating apparatus may be configured to perform coating by using coating powder, for example, as follows. First, the powder coating apparatus uses the developing device 24 of the third exemplary embodiment as a powder coating head which is an example of the powder adhering device 7 in an electrostatic powder coating method, and transports the conductive sheet-shaped object 9 close to the powder coating head while the transport guide device 13 guides and transports the sheet-shaped object 9. Subsequently, a bias voltage is supplied between the powder coating head and the conductive sheet-shaped object 9, whereby charged coating powder (for example, thermosetting toner) from the powder coating head is applied onto the sheet-shaped object 9. Thereafter, the surface of the sheet-shaped object 9 is coated by heating the sheet-shaped object 9.

Further, in this powder coating apparatus, the replenishment container 28 according to the third exemplary embodiment is configured as a powder container in which coating powder is accommodated. Further, in this powder coating apparatus, the transport guide device 13 guides the sheet-shaped object 9 to be transported to the powder coating head which is the powder adhering portion 7*s* of the powder adhering device 7, and the movable first guide unit 2B using the transport belt 2*d* or the transport roller 2*r* may be applied as the first guide unit. The second guide units 3A and 3B of the first and second exemplary embodiments may be applied as the second guide unit 3 of the transport guide device 13. Further, in this powder coating apparatus, the conductive sheet-shaped object 9, specifically, a metal sheet is applied.

Further, the powder using apparatus 10 according to the third exemplary embodiment may use powder such as carbon powder, magnetic powder, metal powder, chemical powder, or food powder, and may include the powder adhering device 7 which causes the powder to adhere to the sheet-shaped object 9 and the transport guide device 13 which guides the sheet-shaped object 9 along the transport path Rt along which the sheet-shaped object 9 is sent to the powder adhering portion 7*s* of the powder adhering device 7.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transport guide device comprising:

a first guide comprising a guide portion configured to guide a sheet-shaped object along a transport path; and a second guide comprising a fixed first end portion and a non-fixed second end portion opposite to the fixed first end portion, the second end portion (i) approaching the guide portion toward a downstream side in a transport direction of the sheet-shaped object and then contacts with the guide portion or (ii) approaching the guide portion toward the downstream side in the transport direction of the sheet-shaped object, the second guide being configured to guide the sheet-shaped object such that the sheet-shaped object comes into contact with the guide portion, wherein the second guide comprises a tip end protrusion at a tip end of the second end portion, the tip end protrusion protruding in a direction away from the guide portion, and the second guide comprises a lateral protrusion at least at a part of a lateral end in a width direction of the sheet-shaped object in transport, the lateral protrusion protruding in the direction away from the guide portion, the lateral protrusion being continuous with the tip end protrusion.

2. The transport guide device according to claim 1, wherein the tip end protrusion is a portion including a surface that rises at least in the direction away from the guide portion.

3. The transport guide device according to claim 2, wherein the tip end protrusion is a bent portion of the second end portion of a main body extending from the first end portion to the second end portion of the second guide.

4. The transport guide device according to claim 3, wherein the second guide comprises the main body extending from the first end portion to the second end portion, and the main body comprises a sheet-shaped elastic member.

5. The transport guide device according to claim 4, wherein the first end portion of the second guide is fixed to a component comprising a portion that opposes the first guide across the transport path, the component being configured to be replaced at a required timing.

6. The transport guide device according to claim 3, wherein the first end portion of the second guide is fixed to a component comprising a portion that opposes the first guide across the transport path, the component being configured to be replaced at a required timing.

7. The transport guide device according to claim 2, wherein the tip end protrusion comprises another member attached to the second end portion of a main body extending from the first end portion to the second end portion of the second guide.

8. The transport guide device according to claim 7, wherein the second guide comprises the main body extending from the first end portion to the second end portion, and the main body comprises a sheet-shaped elastic member.

9. The transport guide device according to claim 8, wherein the first end portion of the second guide is fixed to a component comprising a portion that opposes the first guide across the transport path, the component being configured to be replaced at a required timing.

10. The transport guide device according to claim 7, wherein the first end portion of the second guide is fixed to a component comprising a portion that opposes the first guide across the transport path, the component being configured to be replaced at a required timing.

11. The transport guide device according to claim 2, wherein the second guide comprises a main body extending from the first end portion to the second end portion, and the main body comprises a sheet-shaped elastic member.

12. The transport guide device according to claim 11, wherein the first end portion of the second guide is fixed to a component comprising a portion that opposes the first guide across the transport path, the component being configured to be replaced at a required timing.

13. The transport guide device according to claim 2, wherein the first end portion of the second guide is fixed to a component comprising a portion that opposes the first guide across the transport path, the component being configured to be replaced at a required timing.

14. The transport guide device according to claim 1, wherein the second guide comprises a main body extending from the first end portion to the second end portion, and the main body comprises a sheet-shaped elastic member.

15. The transport guide device according to claim 14, wherein the first end portion of the second guide is fixed to a component comprising a portion that opposes the first guide across the transport path, the component being configured to be replaced at a required timing.

16. The transport guide device according to claim 1, wherein the first end portion of the second guide is fixed to a component comprising a portion that opposes the first guide across the transport path, the component being configured to be replaced at a required timing.

17. The transport guide device according to claim 1, wherein the first guide comprises a rotating member configured to rotate so as to transport and guide the sheet-shaped object along the transport direction.

18. A sheet-shaped object processing apparatus comprising:

a processing device configured to perform required processing on a sheet-shaped object; and a transport guide device configured to guide the sheet-shaped object along a transport path along which the sheet-shaped object is sent to the processing device, wherein the transport guide device comprises the transport guide device according to claim 1.

19. A powder using apparatus comprising:

a powder adhering device configured to cause a powder to adhere to a sheet-shaped object; and a transport guide device configured to guide the sheet-shaped object along a transport path along which the sheet-shaped object is sent to the powder adhering device, wherein the transport guide device comprises the transport guide device according to claim 1.

* * * * *